US010396509B2

(12) United States Patent
Yamauchi

(10) Patent No.: US 10,396,509 B2
(45) Date of Patent: Aug. 27, 2019

(54) ELECTRICAL CONNECTOR AND ELECTRICAL CONNECTOR DEVICE WITH AN ELASTIC ARM-SHAPED MEMBER THAT ENGAGES A MATING CONNECTOR

(71) Applicant: DAI-ICHI SEIKO CO., LTD., Kyoto-shi (JP)

(72) Inventor: Takao Yamauchi, Tokyo (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 15/955,772

(22) Filed: Apr. 18, 2018

(65) Prior Publication Data

US 2018/0316143 A1 Nov. 1, 2018

(30) Foreign Application Priority Data

Apr. 27, 2017 (JP) ..... 2017-088957

(51) Int. Cl.
*H01R 9/05* (2006.01)
*H01R 24/40* (2011.01)
(Continued)

(52) U.S. Cl.
CPC ..... *H01R 24/40* (2013.01); *H01R 9/05* (2013.01); *H01R 13/40* (2013.01);
(Continued)

(58) Field of Classification Search
CPC ..... H01R 13/6271; H01R 13/6275; H01R 13/6582; H01R 9/0509; H01R 9/053;
(Continued)

(56) References Cited

U.S. PATENT DOCUMENTS 9,490,591 B2 * 11/2016 Yamashita ..... H01R 24/40
2014/0357108 A1 * 12/2014 Aoki ..... H01R 12/772 439/329

(Continued)

FOREIGN PATENT DOCUMENTS

JP 2016-31780 3/2016
KR 10-2012-0093075 A 8/2012

(Continued)

OTHER PUBLICATIONS

Office Action dated Sep. 14, 2018, in European Patent Application No. 18169617.0.

(Continued)

*Primary Examiner* — Abdullah A Riyami
*Assistant Examiner* — Justin M Kratt
(74) *Attorney, Agent, or Firm* — Oblon, McClelland, Maier & Neustadt, L.L.P.

(57) ABSTRACT

To allow a fit-in state between electrical connectors to be firmly maintained, elastic arm-shaped members provided to a conductive shell member so as to elastically displace to a direction orthogonal to a fit-in direction of a mating connector are each provided with an engaging piece having a connector contact surface which the mating connector faces from the depth in the fit-in direction and a shell contact surface which a part of the conductive shell member faces from the front in the fit-in direction. When an external force is applied to the mating connector in a fit-in state to a removing direction opposite to the fit-in direction, the engaging piece is brought into a state of being interposed between the mating connector and the conductive shell member. This avoids a situation in which the engaging piece is removed from the mating connector to cause a lock release.

9 Claims, 30 Drawing Sheets

(51) Int. Cl.

| | |
|---|---|
| ***H01R 13/639*** | (2006.01) |
| ***H01R 13/40*** | (2006.01) |
| ***H01R 13/648*** | (2006.01) |
| ***H01R 13/627*** | (2006.01) |
| ***H01R 13/6581*** | (2011.01) |
| *H01R 101/00* | (2006.01) |
| *H01R 9/053* | (2006.01) |
| *H01R 24/38* | (2011.01) |
| *H01R 4/2495* | (2018.01) |
| *H01R 13/658* | (2011.01) |
| *H01R 13/6582* | (2011.01) |
| *H01R 43/048* | (2006.01) |
| *H01R 13/6592* | (2011.01) |
| *H01R 103/00* | (2006.01) |
| *H01R 24/50* | (2011.01) |

(52) U.S. Cl.

CPC ..... *H01R 13/6273* (2013.01); *H01R 13/639* (2013.01); *H01R 13/648* (2013.01); *H01R 13/6581* (2013.01); *H01R 4/2495* (2013.01); *H01R 9/053* (2013.01); *H01R 9/0509* (2013.01); *H01R 9/0518* (2013.01); *H01R 13/6271* (2013.01); *H01R 13/6275* (2013.01); *H01R 13/658* (2013.01); *H01R 13/6582* (2013.01); *H01R 13/6592* (2013.01); *H01R 24/38* (2013.01); *H01R 24/50* (2013.01); *H01R 43/048* (2013.01); *H01R 2101/00* (2013.01); *H01R 2103/00* (2013.01)

(58) Field of Classification Search

CPC ..... H01R 4/2495; H01R 9/05; H01R 24/38; H01R 9/0518; H01R 13/6592; H01R 13/658; H01R 43/048

USPC .. 439/578, 585, 877, 607.5, 607.51, 607.52, 439/353, 352, 394, 421

See application file for complete search history.

(56) References Cited

U.S. PATENT DOCUMENTS

| | | | | |
|---|---|---|---|---|
| 2015/0118887 | A1* | 4/2015 | Katayanagi ..... | H01R 13/6582 439/353 |
| 2018/0076579 | A1* | 3/2018 | Tokita ..... | H01R 24/38 |

FOREIGN PATENT DOCUMENTS

| | | | | |
|---|---|---|---|---|
| KR | 10-2015-0047420 | A | 5/2015 | |
| WO | WO 2010/041823 | A2 | 4/2010 | |
| WO | WO-2010041823 | A2 * | 4/2010 | ..... H01R 13/422 |

OTHER PUBLICATIONS

Office Action dated Jan. 25, 2019 in corresponding Korean Patent Application No. 10-2018-0019174, 5 pages.

* cited by examiner

ELECTRICAL CONNECTOR AND ELECTRICAL CONNECTOR DEVICE WITH AN ELASTIC ARM-SHAPED MEMBER THAT ENGAGES A MATING CONNECTOR

TECHNICAL FIELD OF THE INVENTION

The present invention relates to an electrical connector configured to fit in a mating connector, and an electrical connector device.

BACKGROUND OF THE INVENTION

In general, electrical connector devices in which paired electrical connectors fit in each other for electrical connection have been widely used among various electrical appliances. In these electrical connector devices, a lock mechanism is often adopted to maintain a fit-in state of the paired electrical connectors when fitting in each other. For example, a so-called mechanical lock mechanism disclosed in Japanese Unexamined Patent Application Publication No. 2016-31780 and so forth is configured to acquire fit-in retentivity by a mechanically engaging lock piece. This mechanical lock mechanism is configured such that when an external force is applied to an electrical connector in a fit-in state (mating connector) in a removing direction opposite to a fit-in direction, lock pieces provided to both electrical connectors make contact with each other in the removing direction to have an engaged relation, thereby maintaining the fit-in state of the electrical connectors.

However, in the conventional lock mechanism provided to the electrical connector device, no member is provided to support the lock piece against an external force applied in the direction of removing the electrical connector in the fit-in state (mating connector). Therefore, a critical load against the external force in the removing direction would be insufficient. Even if a relatively slight external force is applied, the engaging relation of the lock mechanism may be released or the lock mechanism may be broken, thereby possibly damaging the electrical connection.

The inventor of the present application discloses Japanese Unexamined Patent Application Publication No. 2016-31780 as a prior art document of the present invention.

Thus, an object of the present invention is to provide an electrical connector and electrical connector device allowing a fit-in state between electrical connectors to be firmly maintained.

SUMMARY OF THE INVENTION

To achieve the above-described object, a first aspect of the present invention is directed to an electrical connector which a mating connector having a terminal portion of a signal transmission medium coupled thereto fits in, the electrical connector including a contact member extending to a fit-in direction of the mating connector and arranged so as to be able to make contact with an electrode part of the mating connector, and a conductive shell member arranged in a state of surrounding at least part of the contact member. The electrical connector adopts a structure in which the conductive shell member is provided with an elastic arm-shaped member which makes contact with the mating connector when fitting in the mating connector and elastically displaces in a direction orthogonal to the fit-in direction, the elastic arm-shaped member is provided with an engaging piece which makes contact with the mating connector, and the engaging piece has a connector contact surface and a shell contact surface, the connector contact surface making contact with a contact face of the mating connector at a depth of the engaging piece in the fit-in direction when an external force is applied to the mating connector in a fit-in state to a removing direction opposite to the fit-in direction, and the shell contact surface provided to oppose the connector contact surface and making contact with a part of the conductive shell member when the contact face of the mating connector makes contact with the connector contact surface to restrict movement of the mating connector.

According to the above-structured electrical connector of the first aspect, when an external force is applied to the mating connector in the fit-in state in the removing direction opposite to the fit-in direction, the contact surface of the mating connector makes contact with the connector contact surface of the engaging piece, and the shell contact surface provided so as to oppose the connector contact surface of the engaging piece makes contact with the part of the conductive shell member to restrict movement of the mating connector. This avoids a situation in which the engaging piece is removed from the mating connector to cause a lock release.

A second aspect of the present invention is directed to an electrical connector device including a first connector having a terminal portion of a cable-shaped signal transmission medium coupled thereto and a second connector which the first connector fits in, the second connector being provided with a contact member extending in a fit-in direction of the first connector and arranged so as to be able to make contact with an electrode part of the first connector and a conductive shell member arranged in a state of surrounding at least part of the contact member. The electrical connector device adopts a structure in which the conductive shell member of the second connector is provided with an elastic arm-shaped member which makes contact with the first connector when the first connector and the second connector fit in and elastically displaces in a direction orthogonal to the fit-in direction, the elastic arm-shaped member of the second connector is provided with an engaging piece which makes contact with the first connector, and the engaging piece of the second connector has a connector contact surface which makes contact with a contact face of the first connector at a depth of the engaging piece in the fit-in direction when an external force is applied to the first connector in a fit-in state in a removing direction opposite to the fit-in direction, and a shell contact surface provided to oppose the connector contact surface and making contact with the conductive shell member when the contact face of the first connector makes contact with the connector contact surface to restrict movement of the first connector.

According to the above-structured electrical connector device of the second aspect, when an external force is applied to the first connector in the fit-in state in the removing direction opposite to the fit-in direction, a part of the first connector makes contact with the connector contact surface of the engaging piece, and the shell contact surface provided to oppose the connector contact surface of the engaging piece makes contact with part of the conductive shell member to restrict movement of the first connector. This avoids a situation in which the engaging piece is removed from the first connector to cause a lock release.

Furthermore, as in a third aspect of the present invention, a structure is preferably adopted in which after protruding from the conductive shell member in the fit-in direction or a direction opposite thereto, the elastic arm-shaped member extends in a state of being folded in a direction opposite to a protruding direction.

According to the above-structured electrical connector of the third aspect, the length of the elastic arm-shaped member is increased by the folded portion, and elastic displacement of the engaging piece provided to the elastic arm-shaped member is sufficiently ensured.

Still further, as in a fourth aspect of the present invention, the elastic arm-shaped member and the engaging piece can be provided as a set in a state of opposing to a direction orthogonal to the fit-in direction.

Yet still further, as in a fifth aspect of the present invention, the conductive shell member which the shell contact surface of the engaging piece faces can be partially configured of an opening edge part of a through hole provided in the conductive shell member to have the engaging piece inserted therein.

Yet still further, as in a sixth aspect of the present invention, the conductive shell member is preferably provided with a release operating part which displaces the conductive shell member to a position where the engaging piece does not make contact with the mating connector or the first connector.

According to the above-structured electrical connector of the sixth aspect, the mating connector or the first connection is easily removed.

Yet still further, as in a seventh aspect of the present invention, the mating connector or the first connector which the connector contact surface of the engaging piece faces can be partially the conductive shell member provided to the mating connector or the first connector.

As described above, in the present invention, the elastic arm-shaped members of the conductive shell member which elastically displaces in a direction orthogonal to the fit-in direction of the mating connector or the first connector are each provided with an engaging piece having a connector contact surface which the mating connector or the first connector faces from the depth in the fit-in direction and the shell contact surface provided to oppose the connector contact surface. When an external force is applied to the mating connector or the first connector in the fit-in state in a removing direction opposite to the fit-in direction, the engaging piece is brought into a state of being interposed between the mating connector or the first connector and the conductive shell member. This avoids a situation in which the engaging piece is removed from the mating connector or the first connector to cause a lock release. Thus, the fit-in state between electrical connectors can be firmly maintained,

BRIEF DESCRIPTIONS OF THE DRAWINGS

FIG. 5A and FIG. 5B depict an insulation housing for use in the plug connector (mating connector) depicted in FIG. 1 to FIG. 4 as being cut along a horizontal plane, in which FIG. 5A is an external sectional perspective view of the insulation housing singly and FIG. 5B is an external sectional perspective view of the insulation housing having the plug contact member attached thereto;

Figure 27:
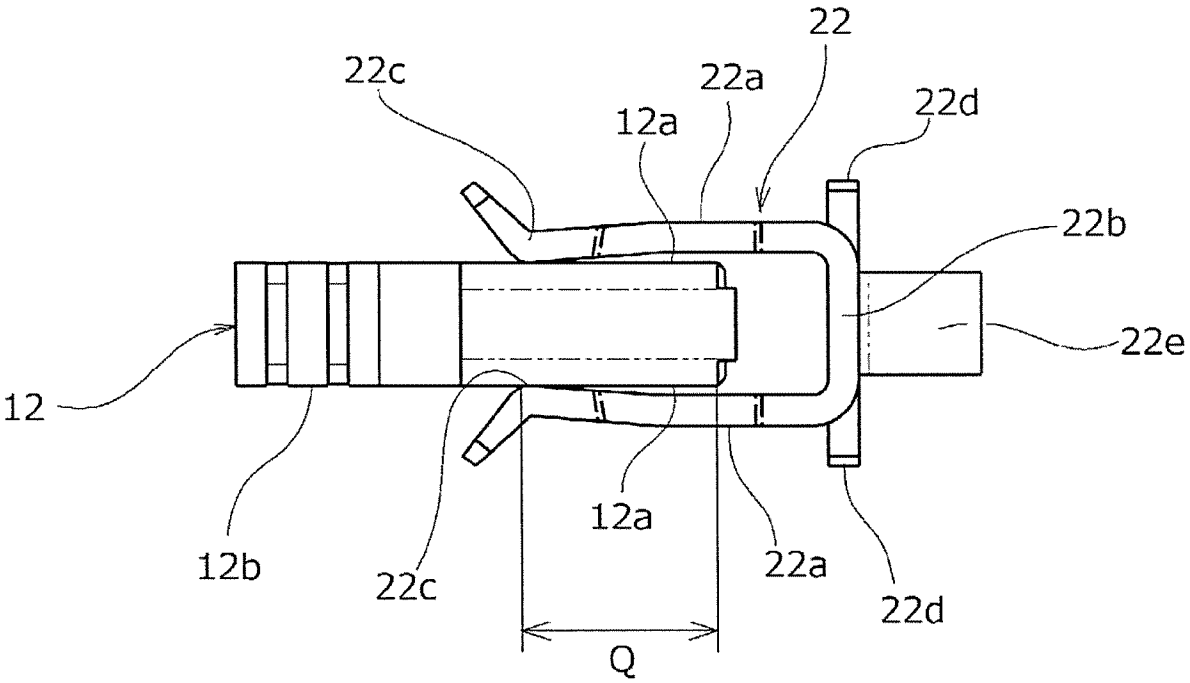
Figure 28A:
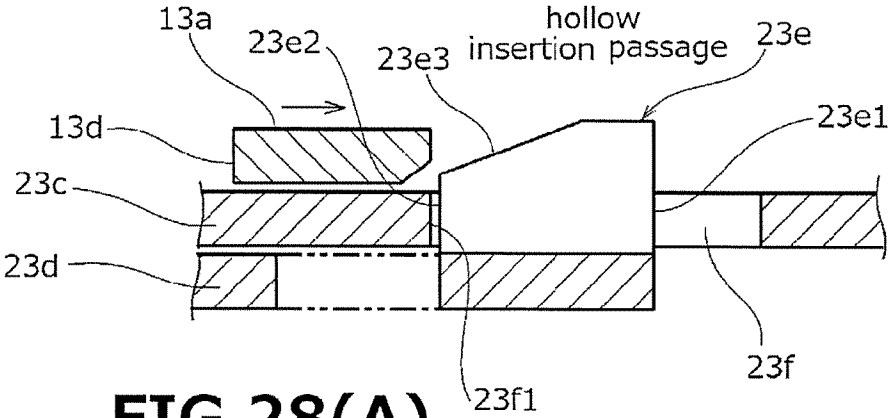
Figure 28B:
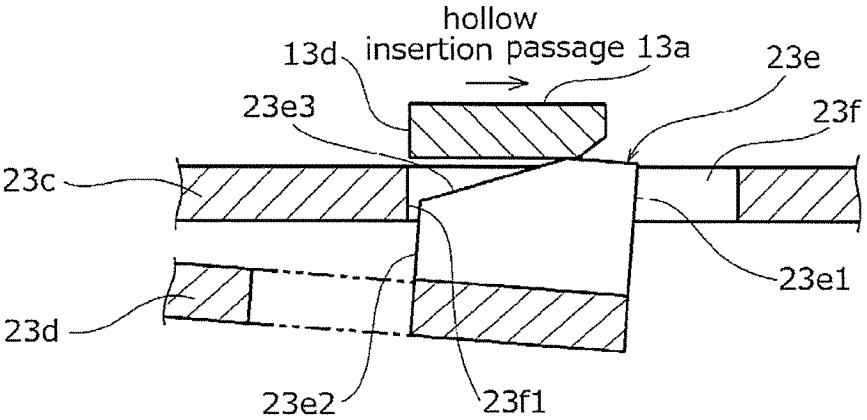
Figure 28C:
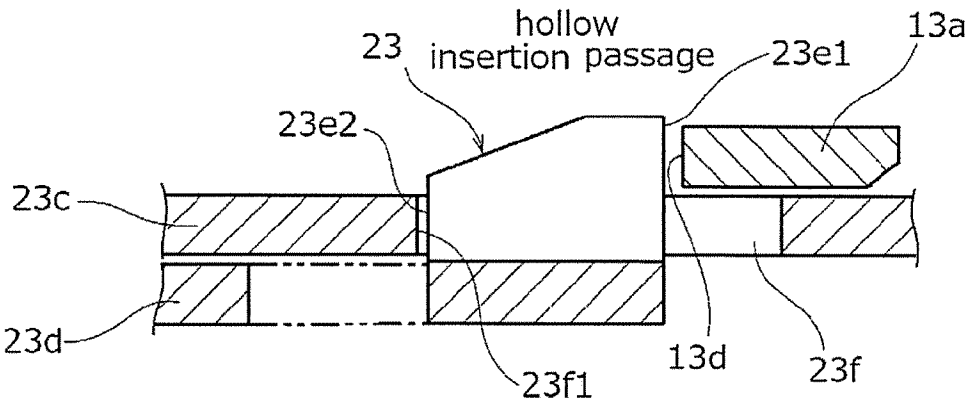
Figure 28D:
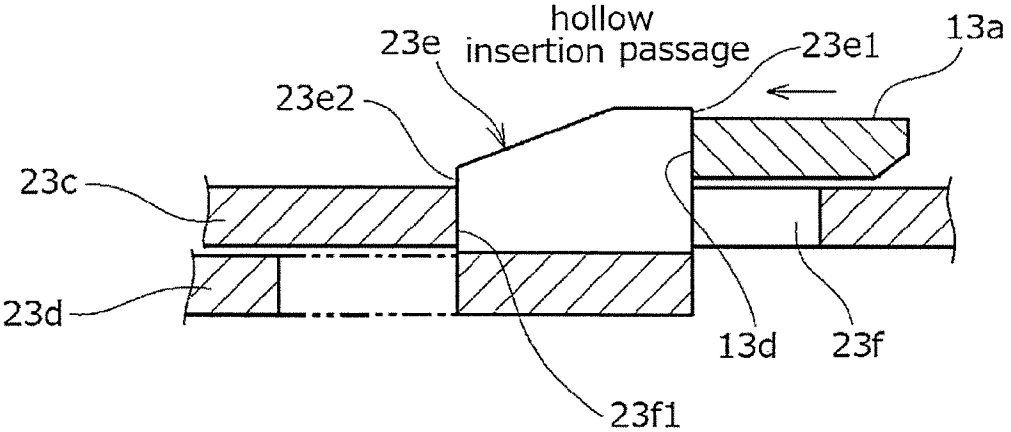

FIG. 27 is a plan view depicting a connection state between the plug contact member and the receptacle contact member; and FIG. 28A to FIG. 28D depict enlarged views depicting elastic displacement states of an engaging piece at stages of fitting the plug connector (first connector) in the receptacle connector (second connector), in which FIG. 28A is a partially-enlarged horizontal sectional view in a stage where the plug connector is started to be inserted, FIG. 28B is a partially-enlarged horizontal sectional view in a stage where the plug connector makes contact with the engaging piece, FIG. 28C is a partially-enlarged horizontal sectional view in a state in which fitting of the plug connector is completed, and FIG. 28D is a partially-enlarged horizontal sectional view in a state in which the plug connector receives an external force in a removing direction.

DESCRIPTIONS OF THE PREFERRED EMBODIMENTS

In the following, an embodiment of the present invention applied to a coaxial electrical connector using a fine-line coaxial cable as a signal transmission medium is described in detail based on the drawings.

[Entire Structure of Coaxial Electrical Connector]

First, a plug connector 10 as a mating connector (first connector) depicted in FIG. 1 to FIG. 5 is configured to have coupled thereto of a terminal portion of a fine-line coaxial cable SC as a cable-shaped signal transmission medium, and a receptacle connector 20 as a coaxial electrical connector (second connector) according to one embodiment of the present invention depicted in FIG. 13 to FIG. 17 is configured to be mounted on a wiring board omitted in the drawings. Into the receptacle connector 20, the plug connector 10 fits as being inserted along an extending direction of a mount surface (main surface) of the wiring board and, and is removed therefrom in an opposite direction. The fitting and removal operation of the plug connector 10 to and from the receptacle connector 20 is performed in a horizontal direction in parallel to the mount surface (main surface) of the wiring board.

Here, as described above, the extending direction of the mount surface (main surface) of the wiring board is taken as a "horizontal direction". Also, a direction away from the mount surface (main surface) of the wiring board in an orthogonal direction is taken as "above" in a "height direction" and, oppositely, a direction approaching toward the mount surface (main surface) of the wiring board is taken as "below" or "lower". Furthermore, a direction in which the plug connector (first connector) 10 fits in the receptacle connector (second connector) 20 is taken as a "fit-in direction". In each of the plug connector 10 and the receptacle connector 20, a direction for fitting in its mating one is taken as "front" and, oppositely, a direction for removal is taken as "back". Furthermore, a direction orthogonal to a "front-and-back direction" for fitting and removal and parallel to the "horizontal direction" is taken as a "width direction".

[Fine-Line Coaxial Cable]

Figure 4:
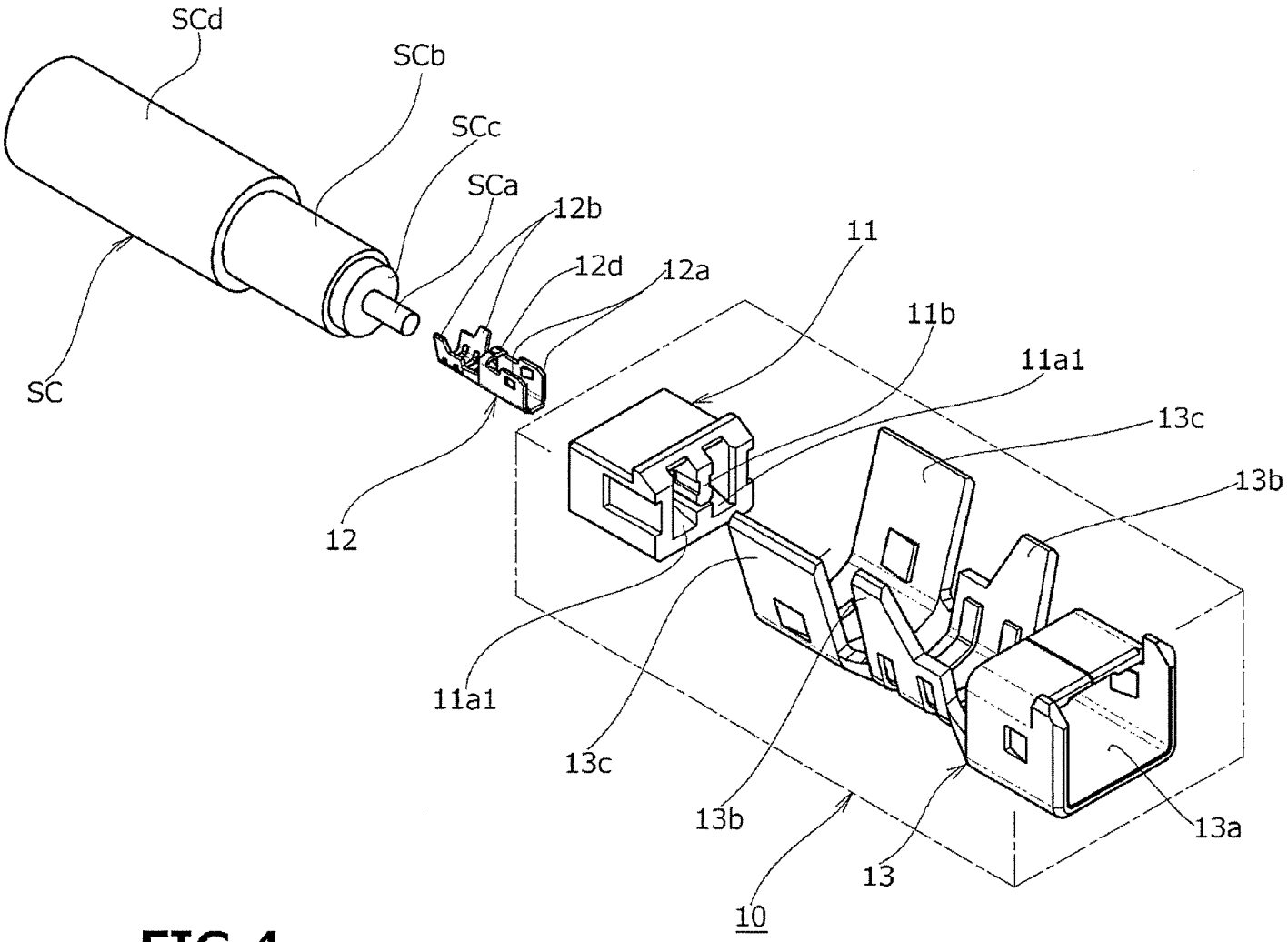
FIG. 4 is a broken perspective view of the plug connector (mating connector) depicted in FIG. 1 to FIG. 3, a coaxial cable (signal transmission medium) coupled to the plug connector, and a plug contact member attached to a terminal portion of the coaxial cable.
Figure 5:
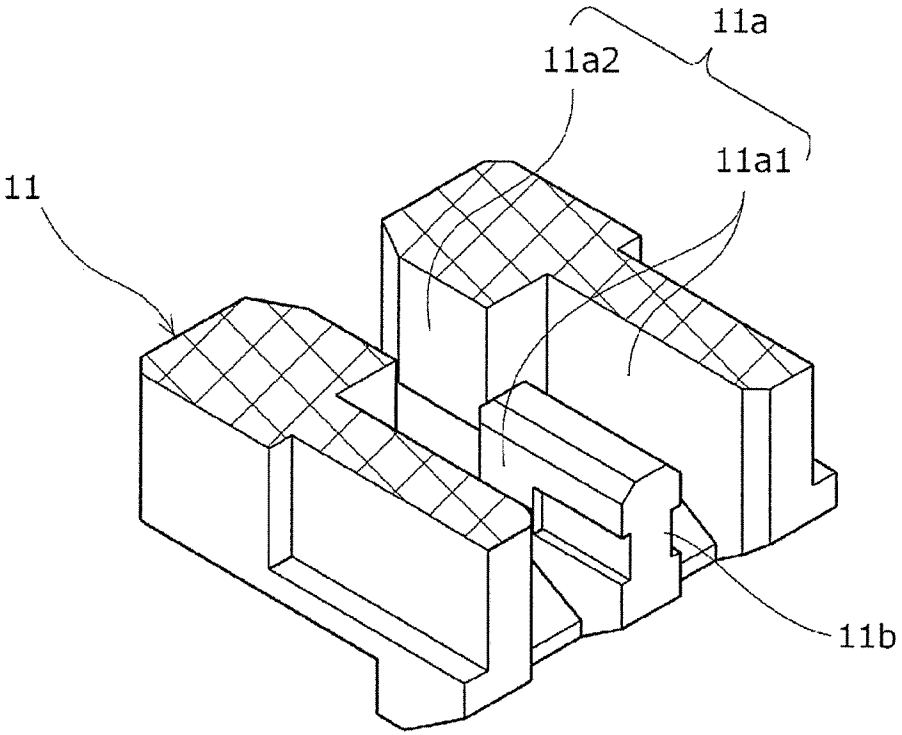
Figure 5:
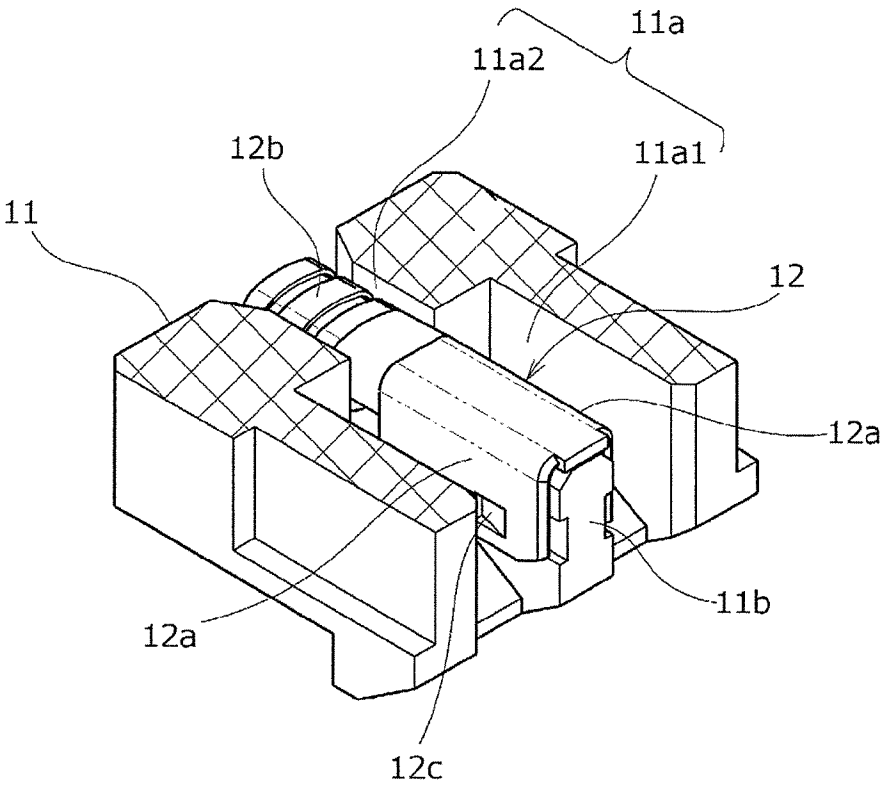

Prior to detailed description of the structure of the plug connector (first connector) 10 and the receptacle connector (second connector) 20 described above, a specific structure of a fine-line coaxial cable SC as a cable-shaped signal transmission medium is described. In particular, as depicted in FIG. 4, the fine-line coaxial cable SC includes a cable center conductor (signal line) SCa along its center axis line. Also, a cable outer conductor (shield line) SCb is coaxially arranged to the cable center conductor SCa via a cable dielectric SCc formed of an insulating material. Of these, the cable outer conductor SCb is brought into an exposed state with an outer-periphery sheathing member SCd stripped off, and the cable center conductor SCa is brought in an exposed state with the cable outer conductor SCb and the cable dielectric SCc stripped off.

Then, the cable center conductor (signal line) SCa of the fine-line coaxial cable SC brought into an exposed state is coupled to a plug contact member 12 attached to an insulation housing 11 as described below for signal connection. Also, the cable outer conductor (shield line) SCb arranged so as to surround the outer periphery side of the cable center conductor SCa is swaged and fixed to part of a conductive shell member 13 described further below for ground connection.

[Plug Connector]

In particular, as depicted in FIG. 4 to FIG. 8, the insulation housing 11 configuring a connector main body portion of the above-described plug connector (first connector) 10 is formed of an insulating member such as resin roughly forming a square pole shape. Provided inside the insulation housing 11 forming a substantially square pole shape is a terminal arrangement space 11*a* which penetrates through the insulation housing 11 in the "front-and-back direction".

A portion at the "front" (depth portion in the fit-in direction) inside the terminal arrangement space 11*a* is formed as a connector fit-in passage 11*a*1 having a relatively-expanded width dimension, in which the plug contact member 12 is arranged. A portion at the "back" (frontward portion in the fit-in direction) of the terminal arrangement space 11*a* is formed as a cable arrangement passage 11*a*2 having a relatively-narrow width dimension, in which an end portion of the fine-line coaxial cable SC coupled to the plug contact member 12 is arranged. Here, a terminal portion of the fine-line coaxial cable SC is brought into a state of protruding from the cable arrangement passage 11*a*2 of the terminal arrangement space 11*a* toward the "back".

When the plug connector (first connector) 10 fits as being inserted inward of the receptacle connector (second connector) 20, a receptacle contact member 22 attached to an insulation housing 21 of the receptacle connector 20 is arranged inside the connector fit-in passage 11*a*1 of the terminal arrangement space 11*a* described above (refer to FIG. 24 to FIG. 27), and the receptacle contact member 22 is brought into a state of making contact with the plug contact member 12, which will be described in detail further below.

On the other hand, particularly as depicted in FIG. 5B, the connector fit-in passage 11*a*1 of the terminal arrangement space 11*a* is provided with a contact attachment part 11*b* in a standing wall shape at an approximately center position in the "width direction". This contact attachment part 11*b* extends in the "front-and-back direction" over a length approximately equal to the length of each electrode part (contact part) 12*a* of the plug contact member 12, which will be described further below, in a state of rising from one of vertically opposing wall parts in the "height direction" of the insulation housing 11. To this contact attachment part 11*b*, the electrode parts 12*a* of the plug contact member 12 are attached in a state of spreading from "above".

[Plug Contact Member]

On the other hand, as described above, in the plug contact member 12 attached to the contact attachment part 11*b* of the insulation housing 11, particularly as depicted in FIG. 8 to FIG. 12, a portion at the "front" of the plug contact member 12 is formed as the electrode parts (contact parts) 12*a*. These electrode parts 12*a* of the plug contact member 12 are formed of a thin metal plate folded so as to form a substantially U shape when viewed along the "front-and-back direction". The electrode parts 12*a* forming a substantially U shape extend over a predetermined length in the "front-and-back direction".

Also, this inner space in the substantially U shape at the electrode parts (contact parts) 12*a* of the plug contact member 12 has a predetermined distance in the "width direction". This distance of the inner space of the electrode parts 12*a* of the plug contact member 12 in the "width direction" is set to be equal to or slightly smaller than the thickness of the contact attachment part 11*b* of the insulation housing 11 described above in the "width direction", the electrode parts 12*a* of the plug contact member 12 are attached in a press-fitted state so as to be covered over the contact attachment part 11*b* of the insulation housing 11 from outside. As a result, as depicted in FIG. 5B, the electrode parts 12*a* of the plug contact member 12 are attached in a state of interposing the contact attachment part 11*b* as part of the insulation housing 11 in the "width direction" orthogonal to the fit-in direction (front-and-back direction).

In this manner, in the present embodiment, the plug contact member 12 is attached as being in a state of interposing the contact attachment part 11*b*, which is part of the insulation housing 11, in the "width direction". Also, the electrode part (contact part) of the receptacle contact member 22 provided to the receptacle connector (second connector) 20 so as to be brought into a fit-in state as will be described further below is brought into a state of pressing the plug contact member 12 in the "width direction" orthogonal to the fit-in direction (front-and-back direction). As a result, the plug contact member 12 is brought into a strongly fixed state with respect to the insulation housing 11.

Here, attachment of the above-described attachment of the electrode parts (contact parts) 12*a* of the plug contact member 12 to the contact attachment part 11*b* of the insulation housing 11 is performed through the cable arrangement passage 11*a*2 of the terminal arrangement space 11*a* from the "back" of the plug connector (first connector) 10 toward the "front" thereof. The attachment state of the plug contact member 12 is maintained with fixing pieces 12*c* provided to the plug contact member 12 engaging with the above-described contact attachment part 11*b* of the insulation housing 11, thereby causing the entire plug contact member 12 to be attached to the insulation housing 11.

Figure 6:
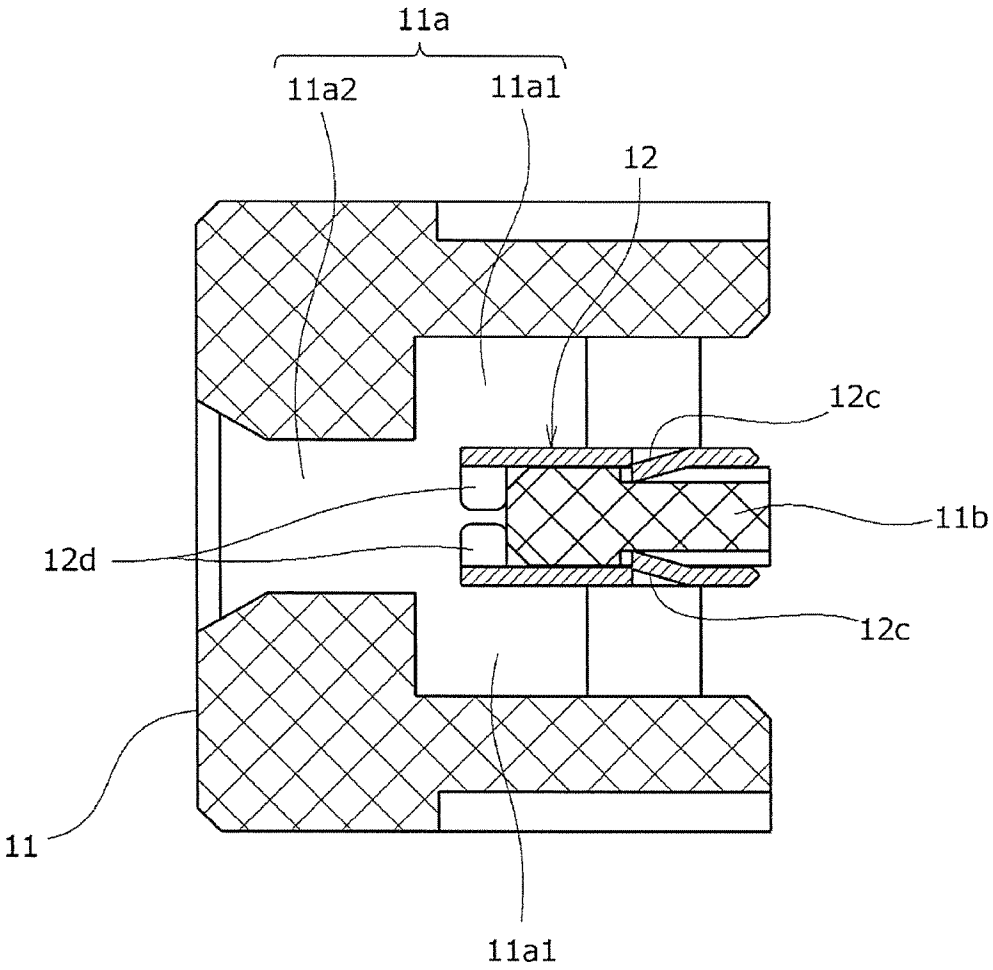
FIG. 6 is a plan view depicting a state in which the plug contact member is attached to the insulation housing for use in the plug connector (mating connector) depicted in FIG. 1 to FIG. 4 as being cut along the horizontal plane.
Figure 7:
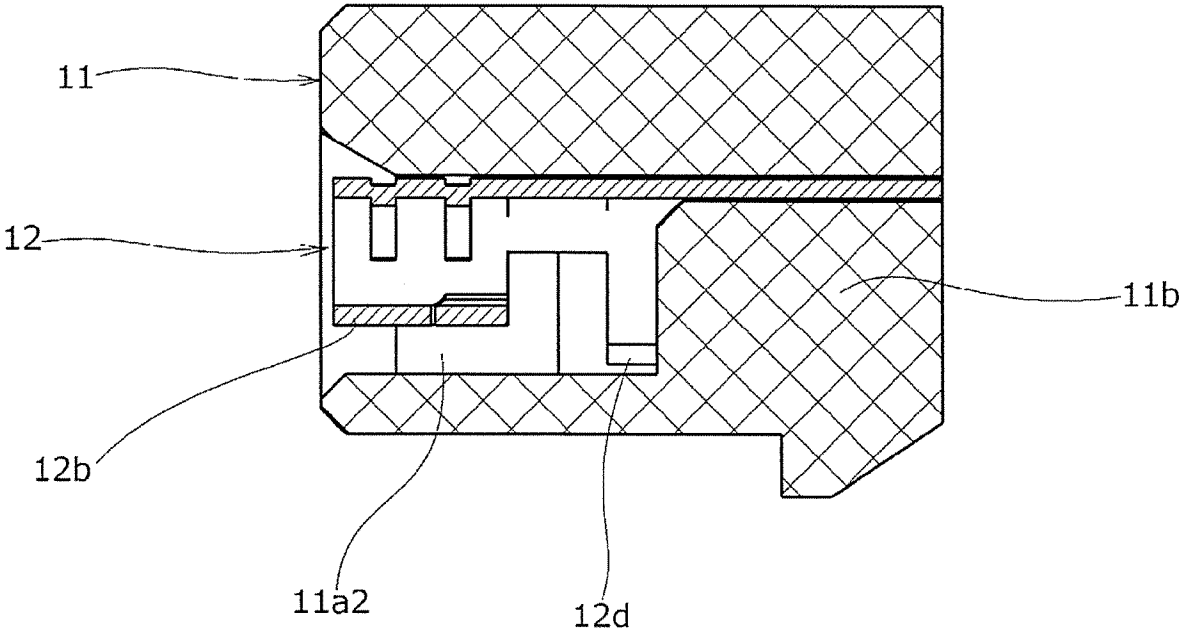
FIG. 7 is a side view depicting a state in which the plug contact member is attached to the insulation housing depicted in FIG. 6 as being cut along a vertical plane in a longitudinal direction.
Figure 8:
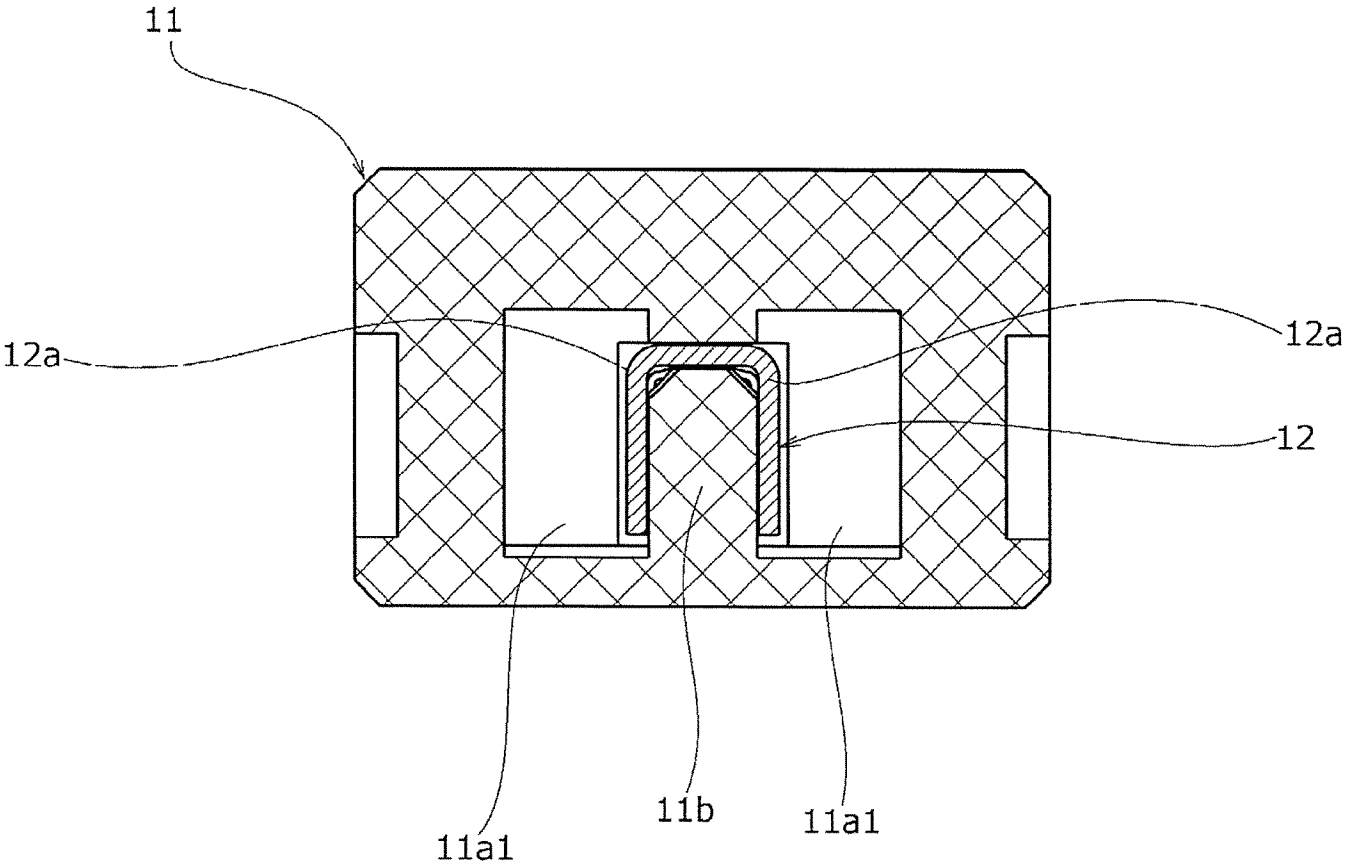
FIG. 8 is a side view depicting a state in which the plug contact member is attached to the insulation housing depicted in FIG. 6 as being cut along a vertical plane in a width direction.
Figure 9:
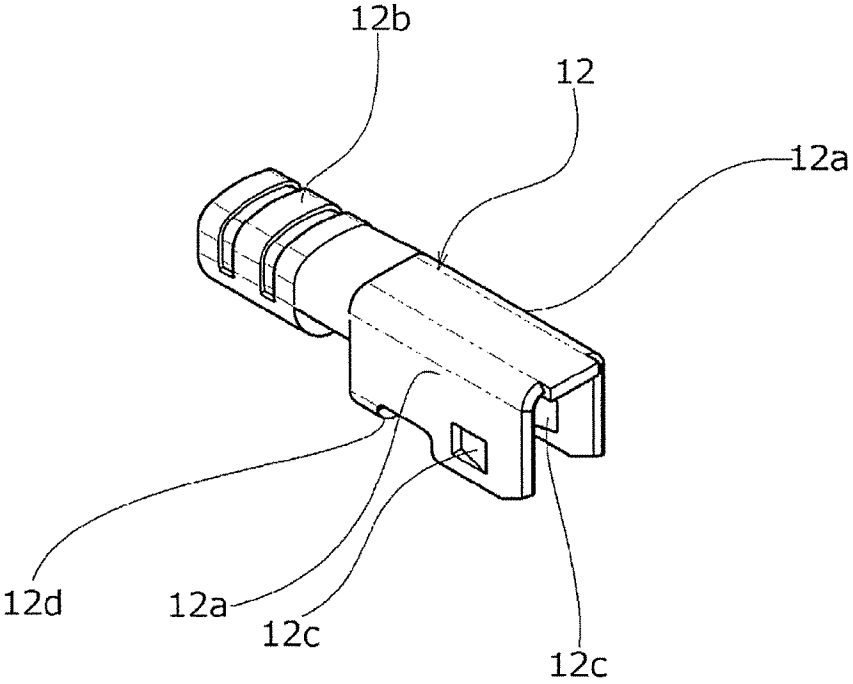
FIG. 9 is an external perspective view of the plug contact member for use in the plug connector (mating connector) depicted in FIG. 1 to FIG. 5 when viewed from front and above.
Figure 10:
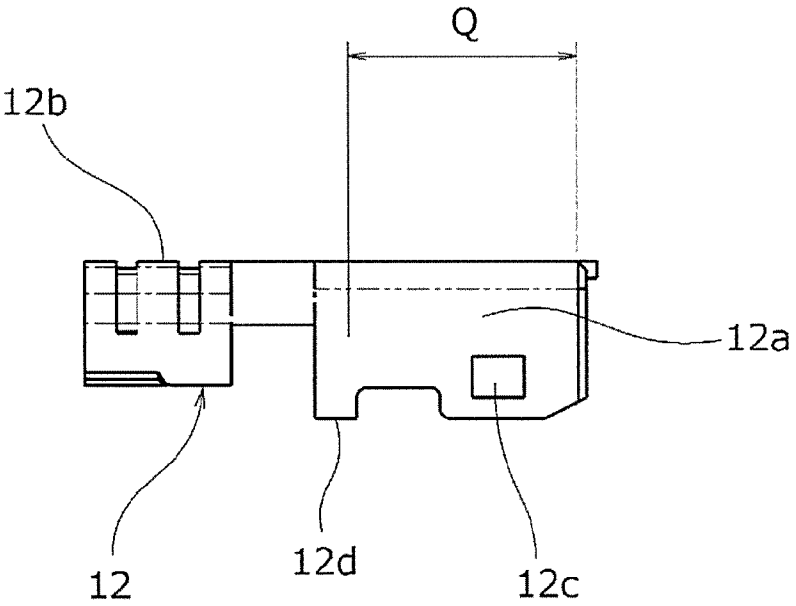
FIG. 10 is a side view of the plug contact member depicted in FIG. 9.

That is, a "lower" region of each electrode part (contact part) 12*a* of the plug contact member 12 in the "height direction" is provided with the fixing piece 12*c* formed by cutting and raising part of the plug contact member 12 to make a nail shape. The fixing pieces 12*c* are provided as a pair in a mutually opposing state on both side wall parts of the plug contact member 12 in the "width direction", as depicted in FIG. 6, and are formed by cutting and raising toward the inner space in the substantially U shape of the plug contact member 12. With both of the fixing pieces 12*c* engaging as digging into both side walls of the contact attachment part 11*b* of the insulation housing 11, the entire plug contact member 12 is brought into a fixed state.

Each fixing piece 12*c* provided to the plug contact member 12 has the following positional relation with the above-described electrode part 12*a* in the fit-in direction (front-and-back direction). That is, when the plug connector (first connector) 10 fits in the receptacle connector (second connector) 20, the electrode part (contact part) 12*a* of the plug contact member 12 slides in the fit-in direction (front-and-back direction) as being in contact with the electrode part (contact part) of the receptacle contact member 22 of the receptacle connector 20, which will be described further below. A region of the electrode part 12*a* of the plug contact member 12 sliding over the electrode part of the receptacle contact member 22 in the fit-in direction (front-and-back direction) is represented by a sign "Q" particularly in FIG. 10 and FIG. 27.

As described above, to the region Q in the fit-in direction (front-and-back direction) where the electrode part (contact part) 12*a* of the plug contact member 12 slides over the electrode part (contact part) of the receptacle contact member 22, each fixing piece 12*c* provided to the plug contact member 12 described above is arranged in an inner region in the fit-in direction (front-and-back direction), that is, within a range of the region Q described above.

According to this structure, the region Q where the electrode part (contact part) 12*a* of the plug contact member 12 slides over the receptacle contact member 22 of the receptacle connector 20 and the region where the fixing piece 12*c* provided to the plug contact member 12 of the plug connector 10 is arranged are in a state of overlapping each other in the fit-in direction (front-and-back direction). As a result, the length of the plug contact member 12 in the fit-in direction (front-and-back direction) is reduced in the fit-in direction, compared with the length of the plug contact member 12 when the electrode part 12*a* and the fixing piece 12*c* are aligned along the fit-in direction (front-and-back direction), thereby decreasing the size of the entire electrical connector device.

Figure 11:
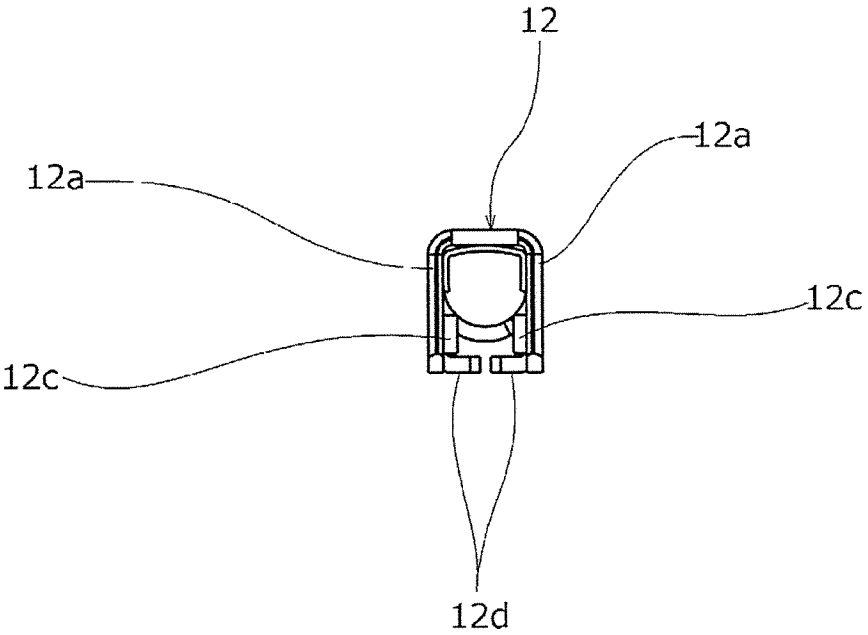
FIG. 11 is a front view of the plug contact member depicted in FIG. 9 and FIG. 10.
Figure 12:
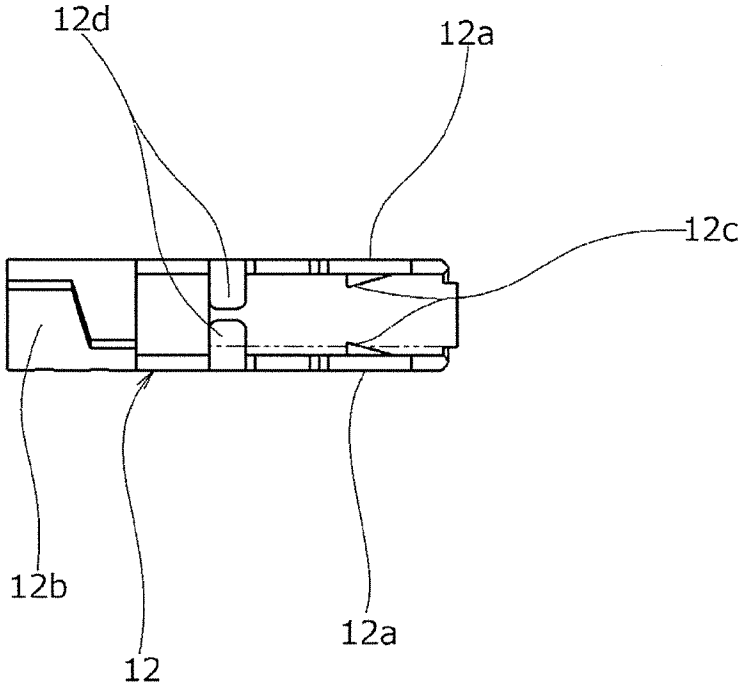
FIG. 12 is a bottom view of the plug contact member depicted in FIG. 9 to FIG. 11.

The paired electrode parts (contact parts) 12*a* of the plug contact member 12 are arranged so as to be opposed to each other in the "width direction" as depicted in FIG. 11 and FIG. 12. At an edge part at the "back" of each of the paired electrode parts 12*a*, an abutting piece 12*d* protruding in the "width" direction toward the opposing mating the electrode part 12*a* is provided. Each of these abutting pieces 12*d* has an arrangement relation so as to face the above-described contact attachment part 11*b* of the insulation housing 11 from the "back". In this arrangement relation, with the attachment of the plug contact member 12 being completed, the abutting pieces 12*d* make contact with an end face at the "back" of the contact attachment part 11*b* of the insulation housing 11.

The structure provided with these abutting pieces 12*d* allows easy and reliable positioning of the plug contact member 12 in the "front-and-back direction", and thus allows stable operation of inserting the plug contact member 12 when the plug contact member 12 is attached to the insulation housing 11.

On the other hand, as depicted in FIG. 4, paired conductor retaining parts 12*b* protruding toward diagonally "above" are integrally provided to a portion at the "back" of the above-described electrode parts (contact parts) 12*a* of the plug contact member 12. These conductor retaining parts 12*b* are configured of a thin plate-shaped metal material folded in a curved shape so as to be wound around the cable center conductor SCa exposed at a terminal portion of the fine-line coaxial cable (cable-shaped signal transmission medium) SC from outside. With the conductor regaining parts 12*b* swaged and fixed to the cable center conductor SCa, the plug contact member 12 is maintained as being coupled to the fine-line coaxial cable SC.

Also, the paired conductor retaining parts 12*b* formed by folding the metal material in a curved shape as described above and the cable center conductor SCa of the fine-line coaxial cable (cable-shaped signal transmission medium)

SC are accommodated inside the cable arrangement passage 11*a*2 provided to a portion at the "back" of the above-described terminal arrangement space 11*a* of the insulation housing 11 (refer to FIG. 5B).

[Conductive Shell Member]

Figure 1:
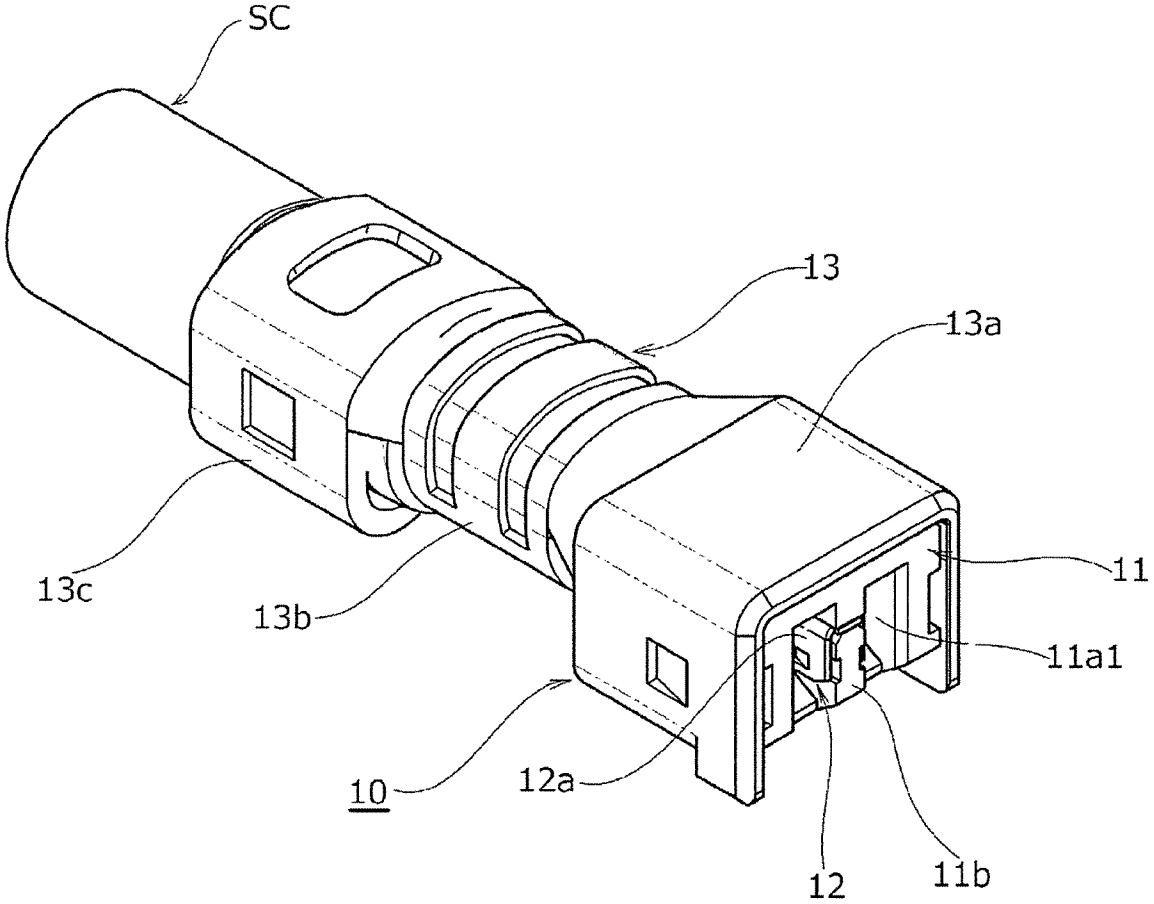
FIG. 1 is an external perspective view of an example of a plug connector as a mating connector (first connector) in the present invention when viewed from front and above.
Figure 2:
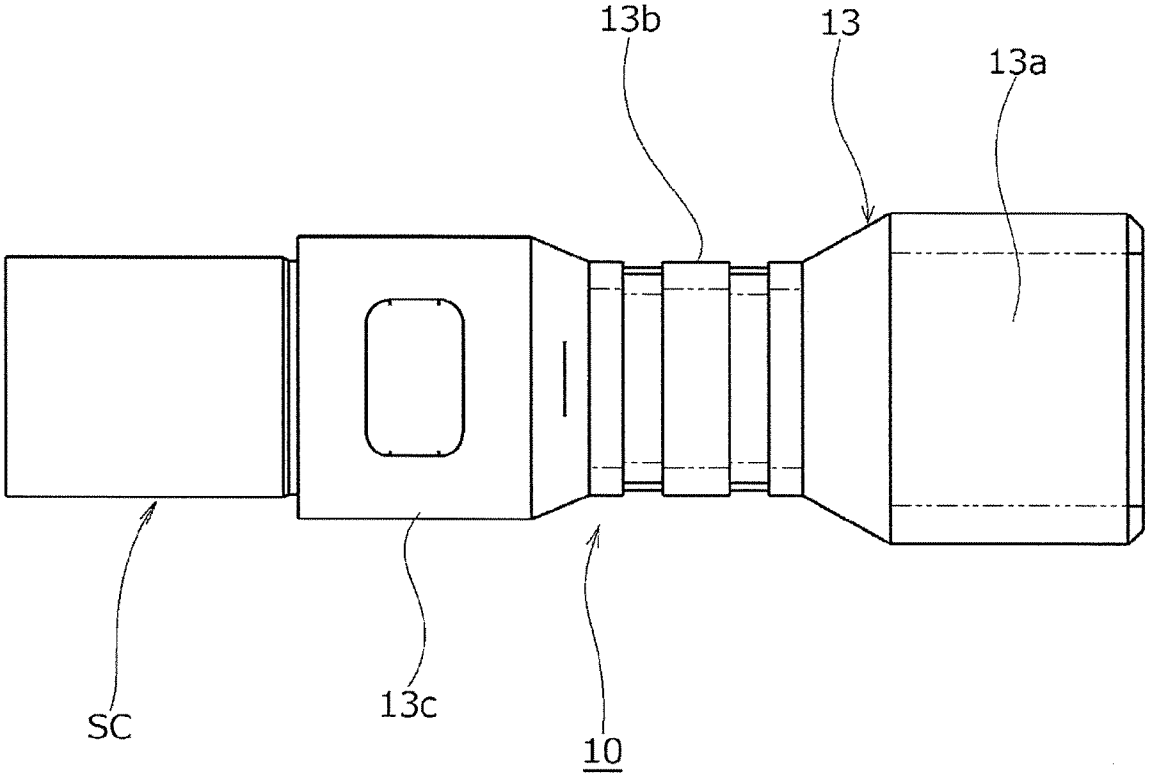
FIG. 2 is a plan view of the plug connector (mating connector) depicted in FIG. 1.
Figure 3:
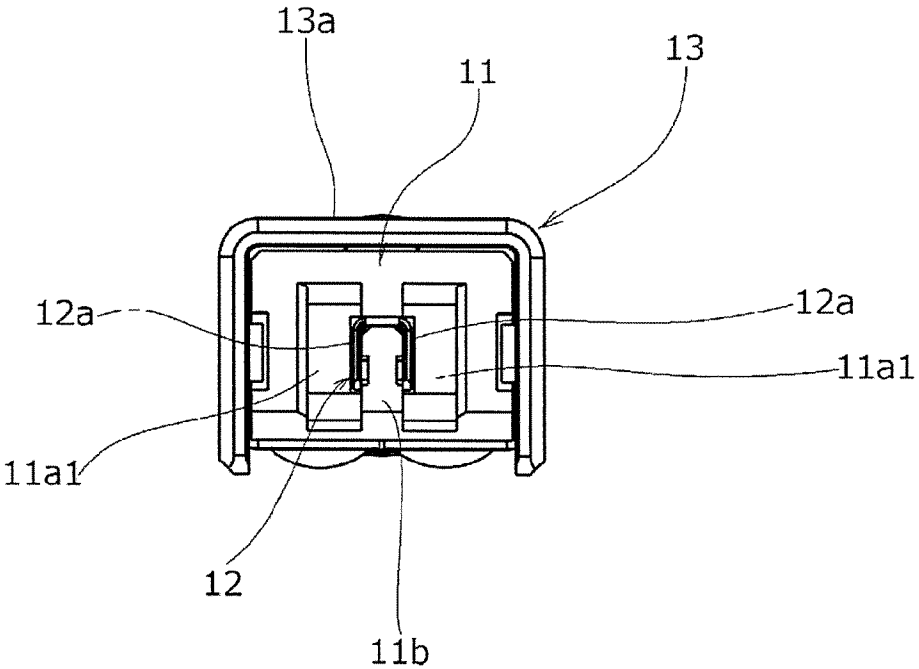
FIG. 3 is a front view of the plug connector (mating connector) depicted in FIG. 1 and FIG. 2.

On the other hand, the outer peripheral surface of the insulation housing 11 is covered with the conductive shell member 13 formed of a thin, plate-shaped metal member as depicted in FIG. 1. At a "front" portion of this conductive shell member 13, a shell main body part 13*a* is provided to cover the outer peripheral surface of the insulation housing 11. The shell main body part 13*a* has a shielding function with respect to the terminal arrangement space 11*a* where the above-described electrode parts (contact parts) 12*a* of the plug contact member 12 are arranged.

Also, from the above-described shell main body part 13*a* toward the "back", a shield retaining part 13*b* integrally protrudes. Furthermore, from the shield retaining part 13*b* toward the "back", an outer sheath retaining part 13*c* integrally protrudes. These shield retaining part 13*b* and the outer sheath retaining part 13*c* are formed of paired thin plate-shaped members protruding diagonally above as depicted in FIG. 4. These shield retaining part 13*b* and the outer sheath retaining part 13*c* are wound from the outside around the cable outer conductor SCb and the outer-periphery sheathing material member SCd exposed at the terminal portion of the fine-line coaxial cable (cable-shaped signal transmission medium) SC, and are swaged and fixed as being folded in a curved shape, thereby bringing the conductive shell member 13 and the plug connector 10 as a whole into a state of being coupled to the fine-line coaxial cable SC.

[General Outline of Receptacle Connector]

Figure 14:
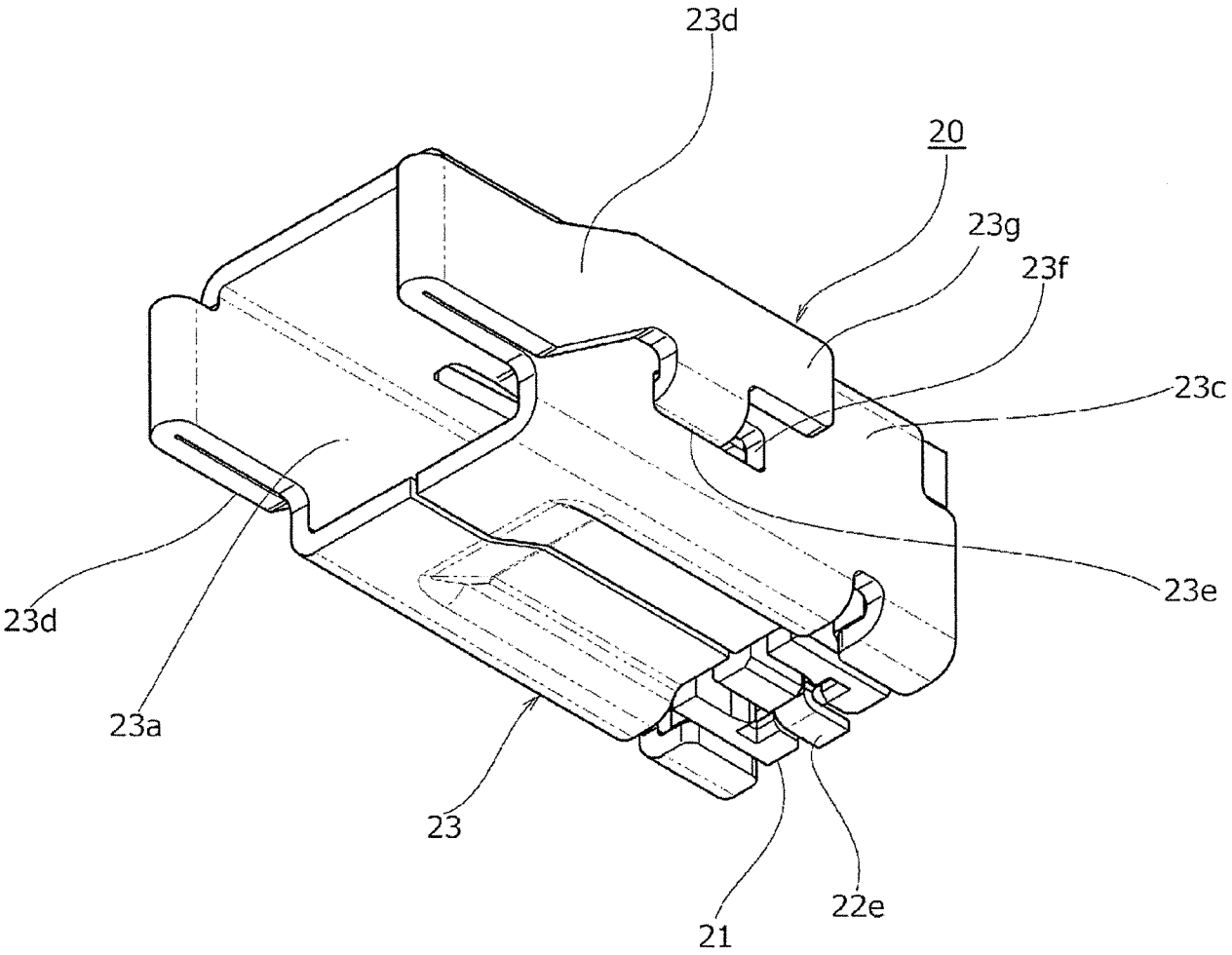
FIG. 14 is an external perspective view of the receptacle connector depicted in FIG. 13 when viewed from front and below.
Figure 15:
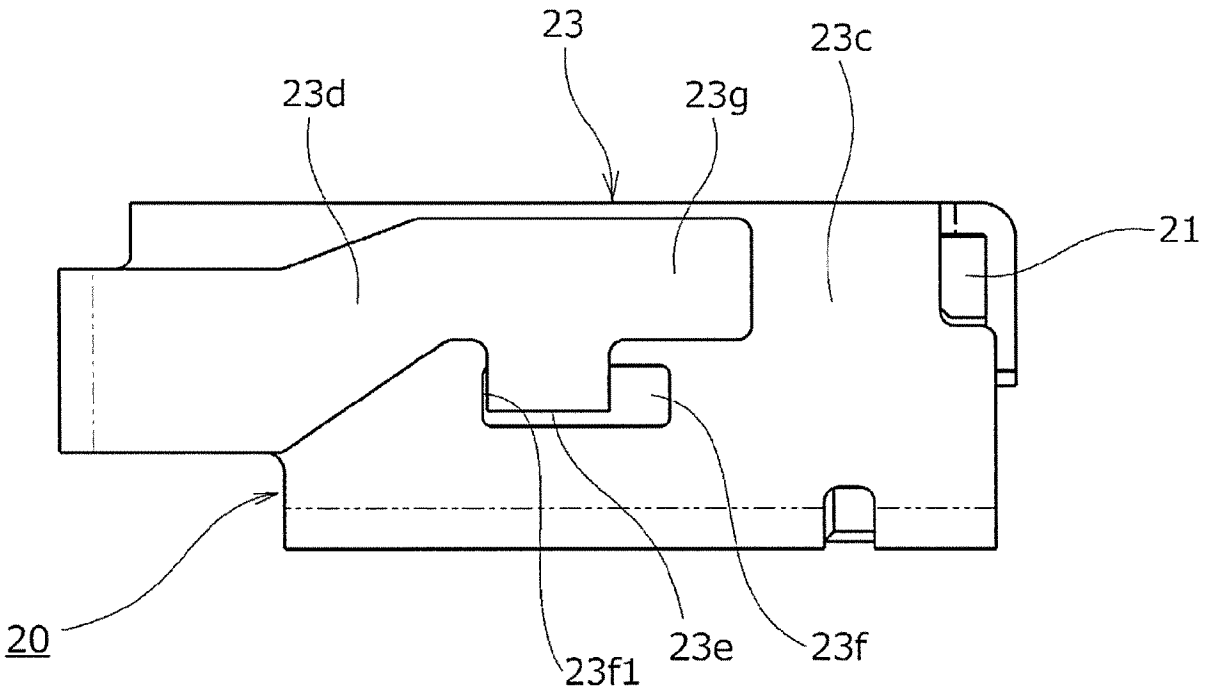
FIG. 15 is a side view of the receptacle connector depicted in FIG. 13 and FIG. 14.
Figure 16:
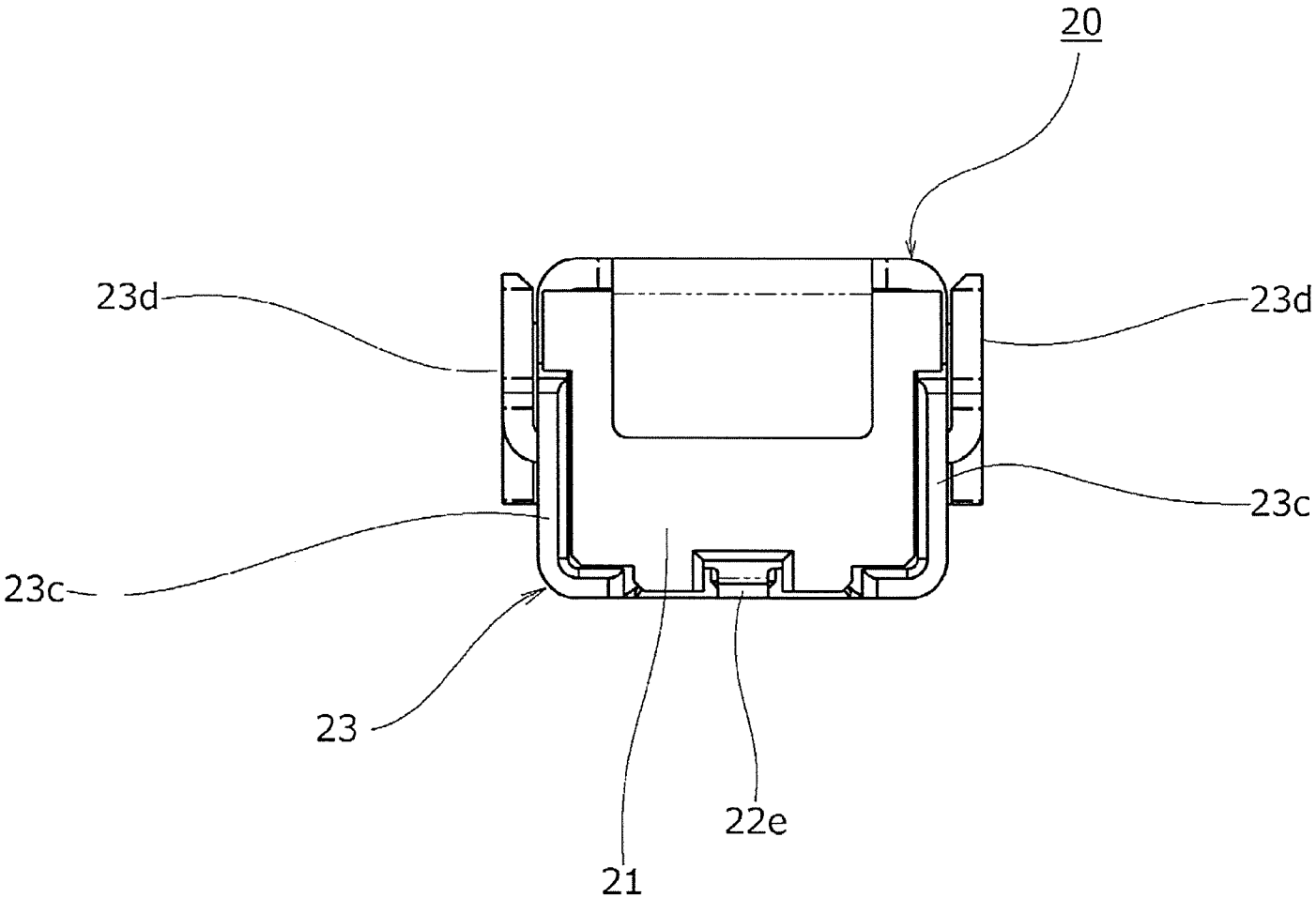
FIG. 16 is a rear view of the receptacle connector depicted in FIG. 13 to FIG. 15.

On the other hand, in the above-described receptacle connector (second connector) 20, particularly as depicted in FIG. 14, the receptacle contact member 22 is attached to the insulation housing 21 configuring the connector main body portion. Also, the insulation housing 21 with the receptacle contact member 22 attached thereto is attached in a press-fitted state inside a "back" end portion, that is, a portion positioned at a depth end in the fit-in direction, of a conductive shell member 23 forming a hollow.

Also, at a "front" end portion, that is, a portion positioned at a front end in the fit-in direction, of the conductive shell member 23, a shell opening 23*a* is provided. From the shell opening 23*a* toward the inside of the hollow of the conductive shell member 23, the above-described plug connector (first connector) 10 is inserted. With the plug connector 10 brought into the fit-in state, the electrode parts (contact parts) 12*a* of the plug contact member 12 (refer to FIG. 1) are brought into a state of making contact with electrode parts (contact parts) 22*a* of the receptacle contact member 22 (refer to FIG. 17) for electrical connection.

[Insulation Housing]

Figure 17:
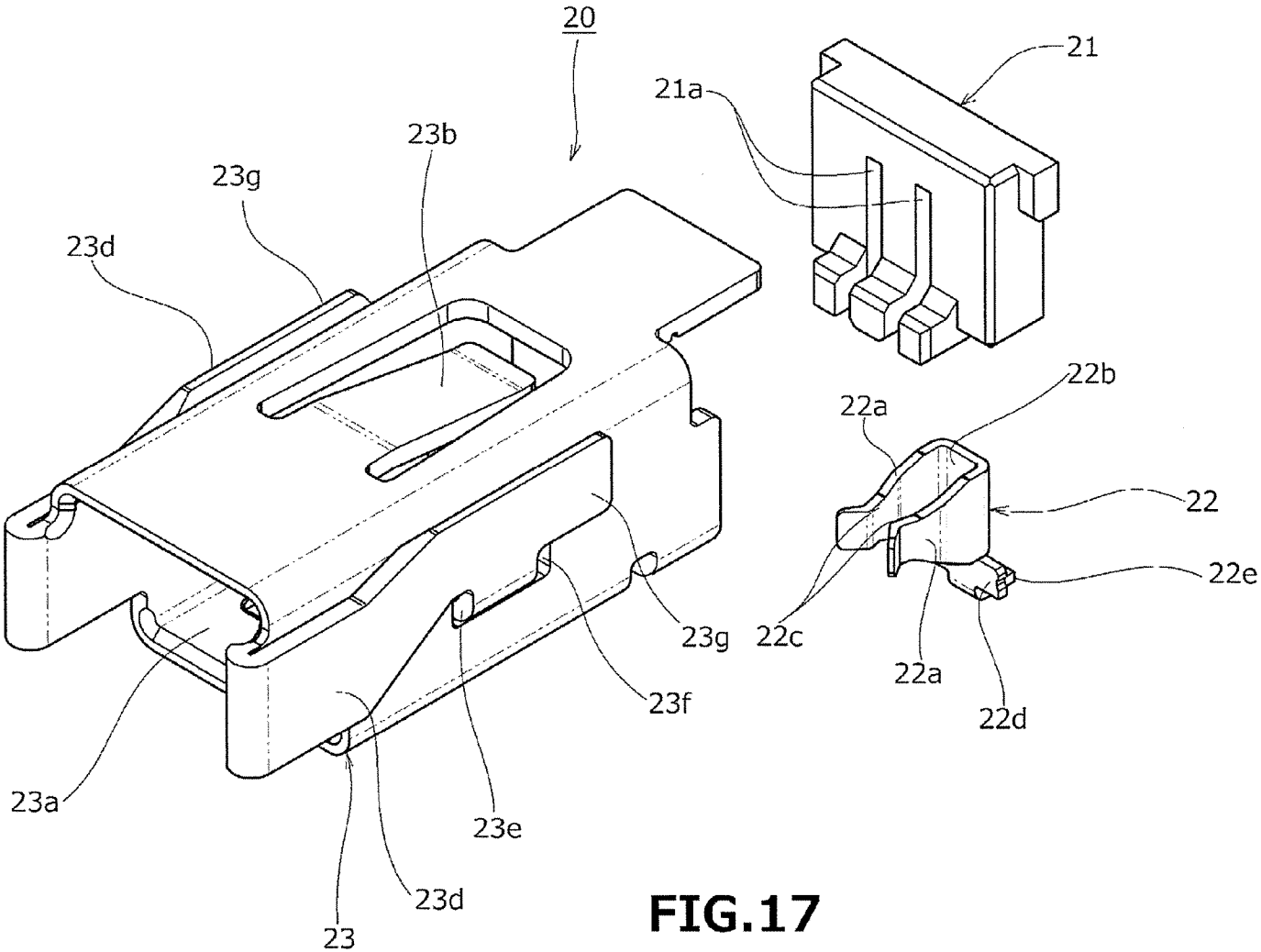
FIG. 17 is a broken external perspective view of the receptacle connector depicted in FIG. 13 to FIG. 16.

As depicted in FIG. 17, the insulation housing 21 of the receptacle connector (second connector) 20 is formed of a plate-shaped insulating member roughly forming a substantially rectangular shape in a front view, and is arranged as being in a state of rising from the main surface of the wiring board (omitted in the drawings) where the receptacle connector 20 is mounted in the "height direction". At a "lower" portion of the insulation housing 21 in this mount state, paired contact attachment grooves 21*a* are provided in a state of extending substantially parallel to each other in an elongated shape as being notched toward the above from the bottom surface of the insulation housing 21. To these paired contact attachment grooves 21*a*, the receptacle contact member 22, which will be described next, are attached in a press-fitted state from "below".

[Receptacle Contact Member]

Figure 18:
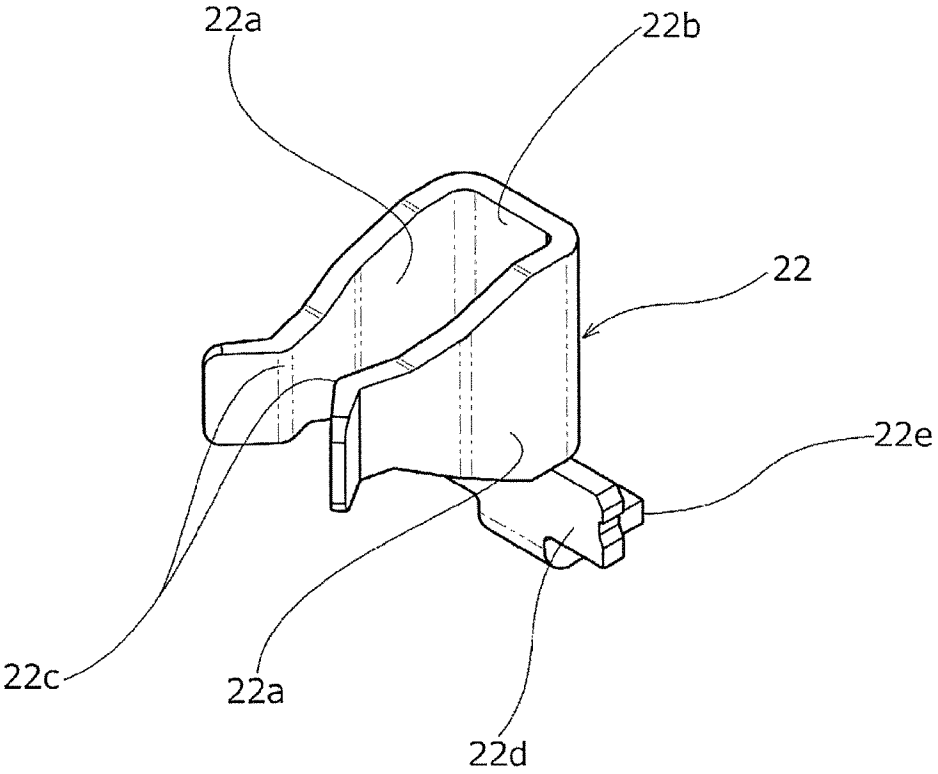
FIG. 18 is an external perspective view of a receptacle contact member for use in the receptacle connector depicted in FIG. 13 to FIG. 17 from front and above.
Figure 19:
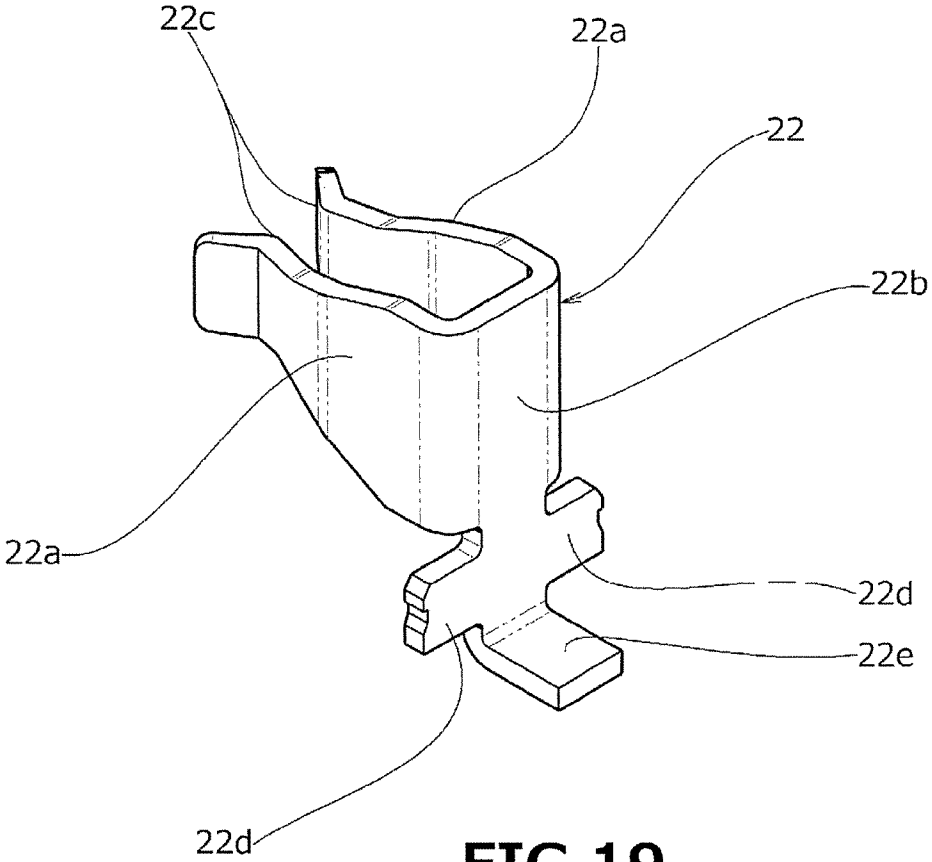
FIG. 19 is an external perspective view of the receptacle contact member depicted in FIG. 18 from rear and above.
Figure 20:
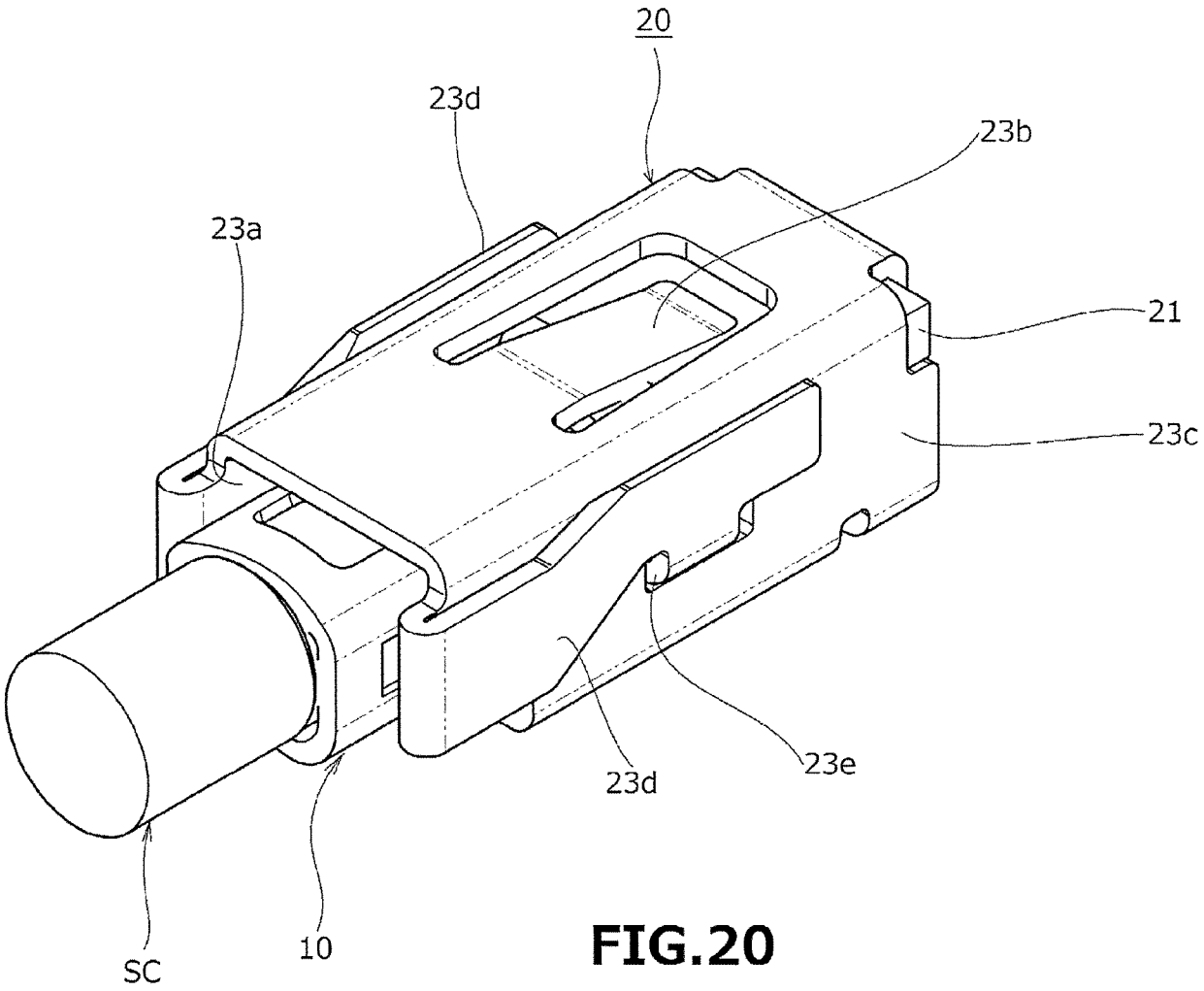
FIG. 20 is an external perspective view depicting a state in which the plug connector as a mating connector (first connector) depicted in FIG. 1 to FIG. 4 fits in the receptacle connector as a coaxial electrical connector according to one embodiment of the present invention depicted in FIG. 13 to FIG. 17, when viewed from front and above the receptacle connector.
Figure 21:
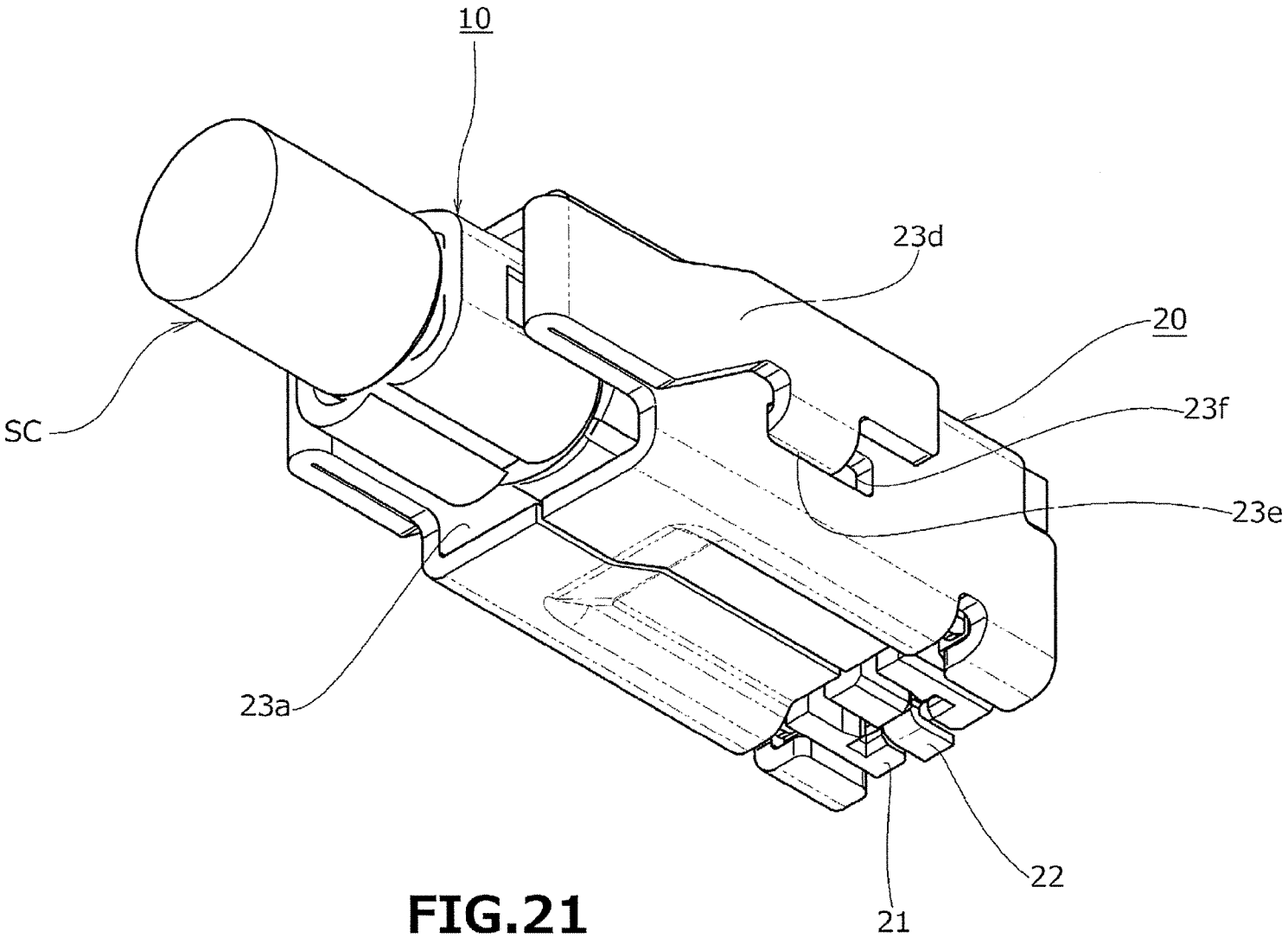
FIG. 21 is an external perspective view depicting a fit-in state of the receptacle connector and the plug connector depicted in FIG. 20 when viewed from front and below the receptacle connector.
Figure 22:
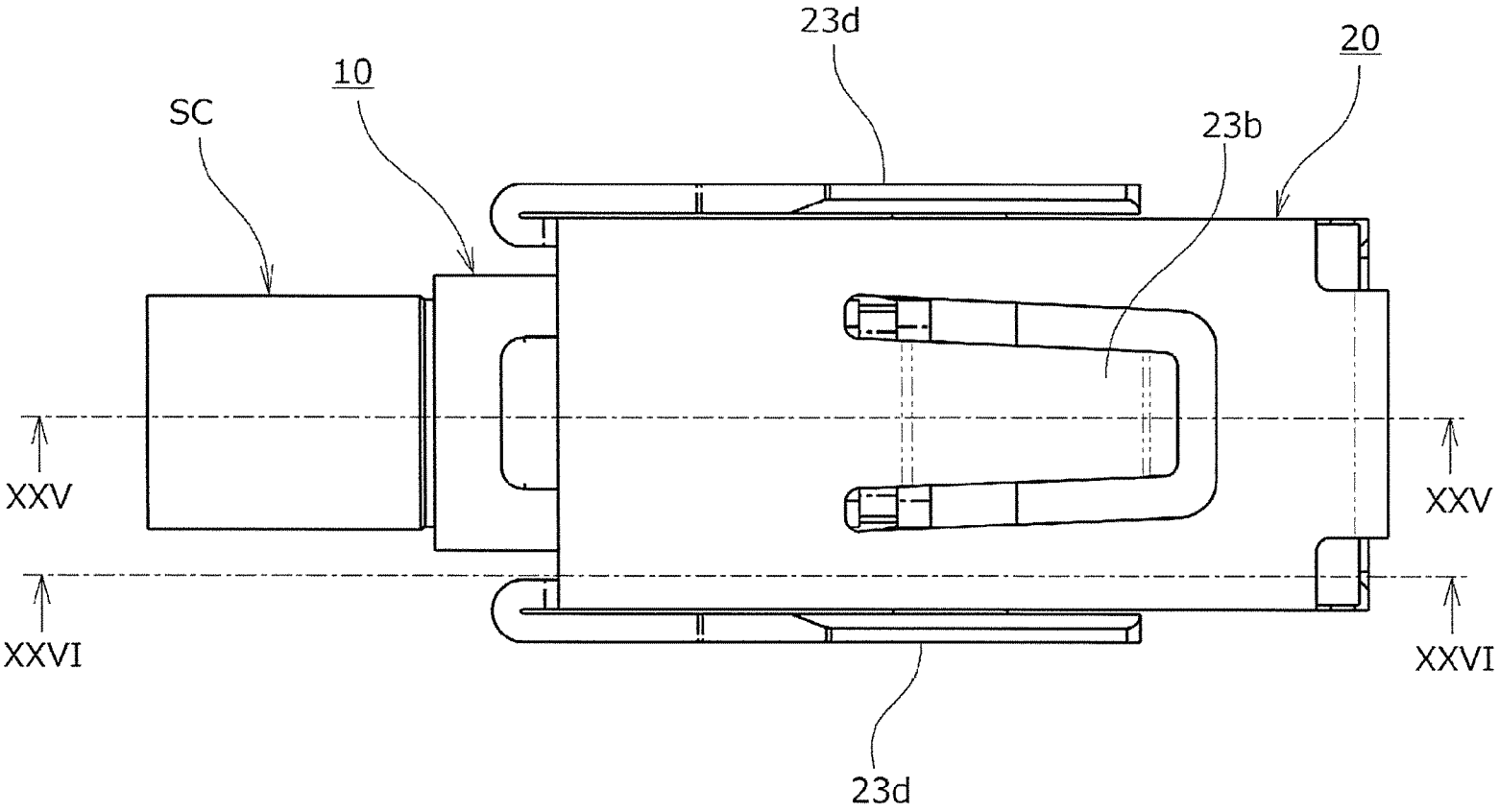
FIG. 22 is a plan view depicting the fit-in state of the receptacle connector and the plug connector depicted in FIG. 20 and FIG. 21.
Figure 23:
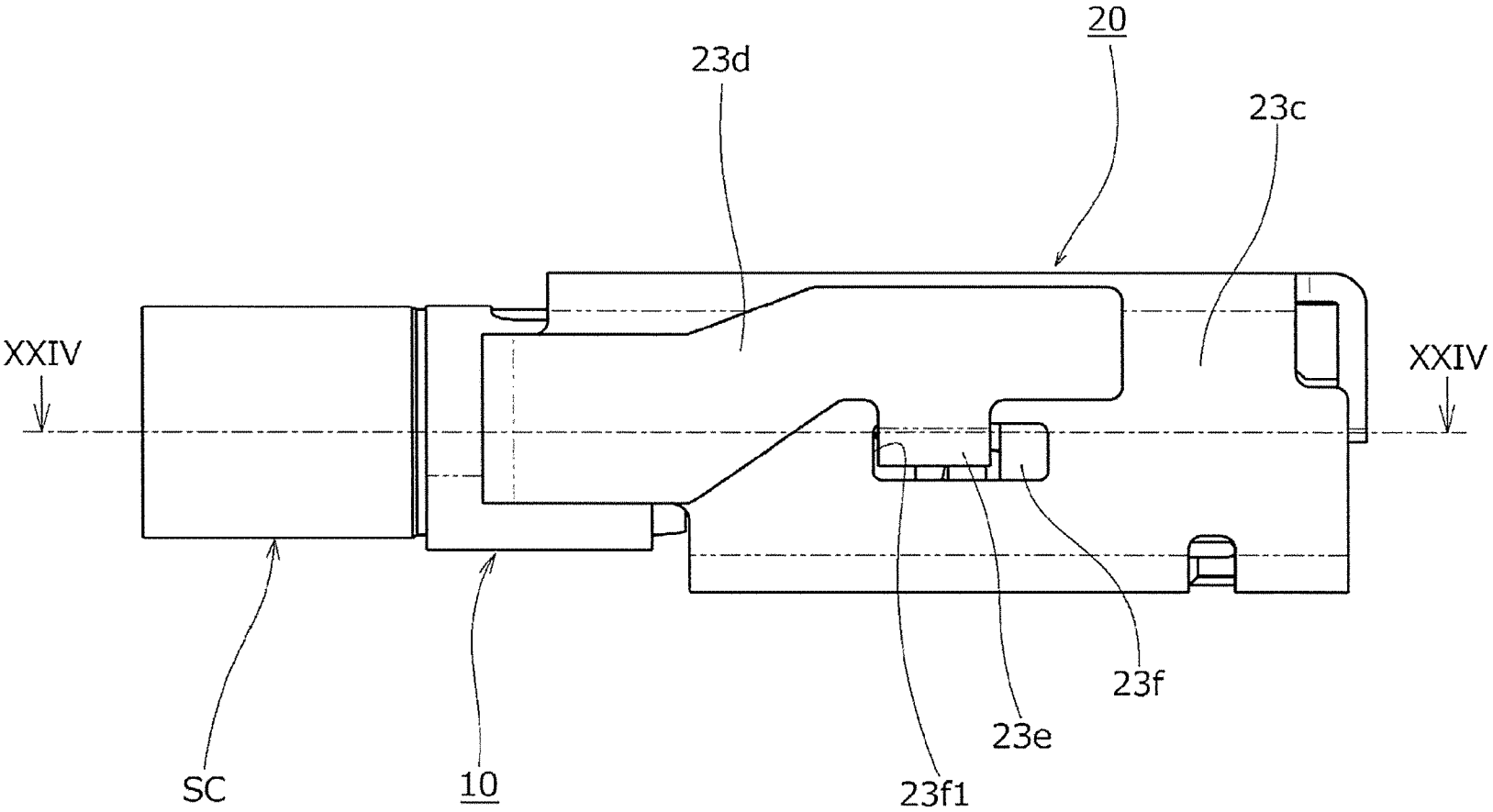
FIG. 23 is a side view depicting the fit-in state of the receptacle connector and the plug connector depicted in FIG. 20 to FIG. 22.
Figure 24:
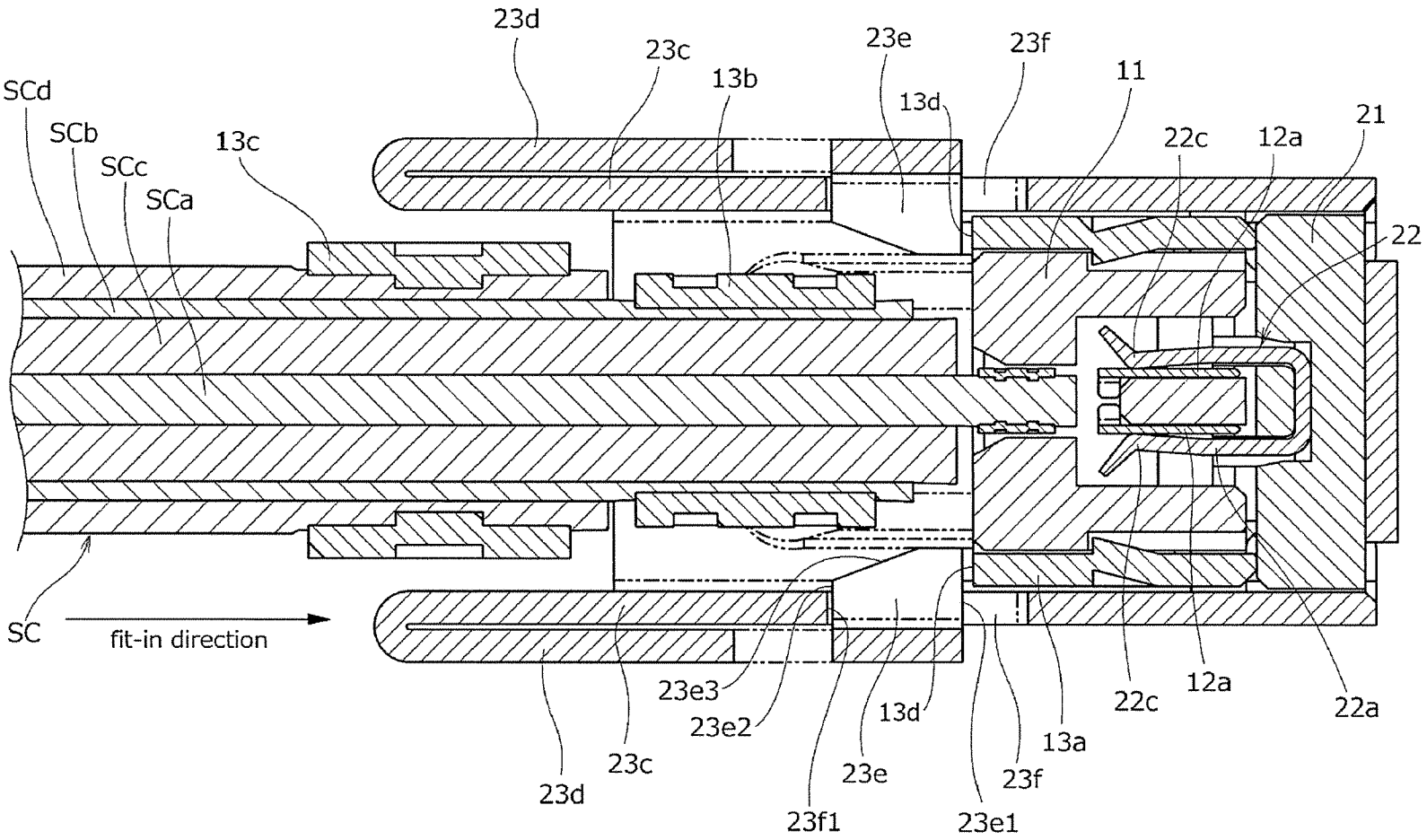
FIG. 24 is a horizontal sectional view along a XXIV-XXIV line in FIG. 23.
Figure 25:
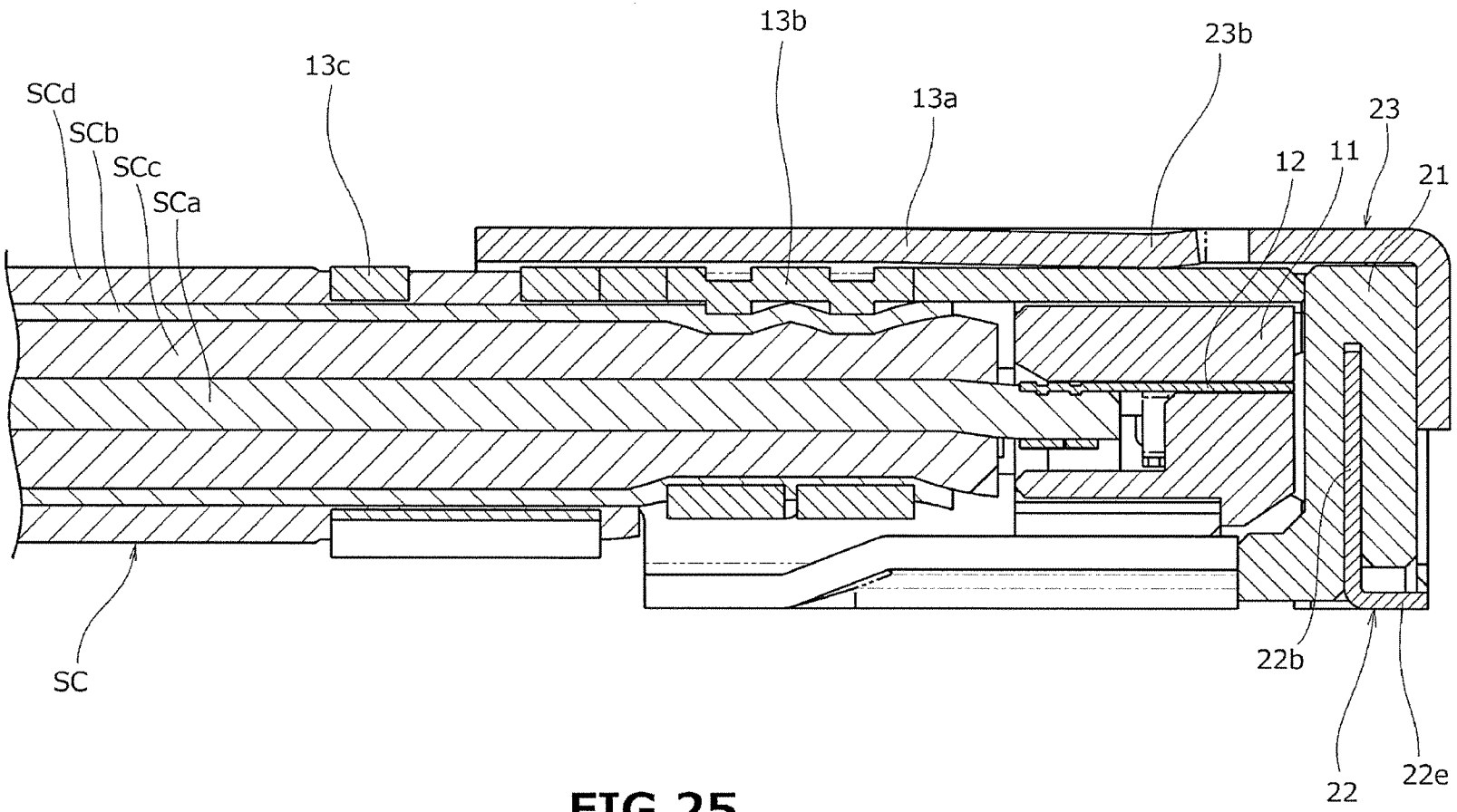
FIG. 25 is a horizontal sectional view along a XXV-XXV line in FIG. 22.
Figure 26:
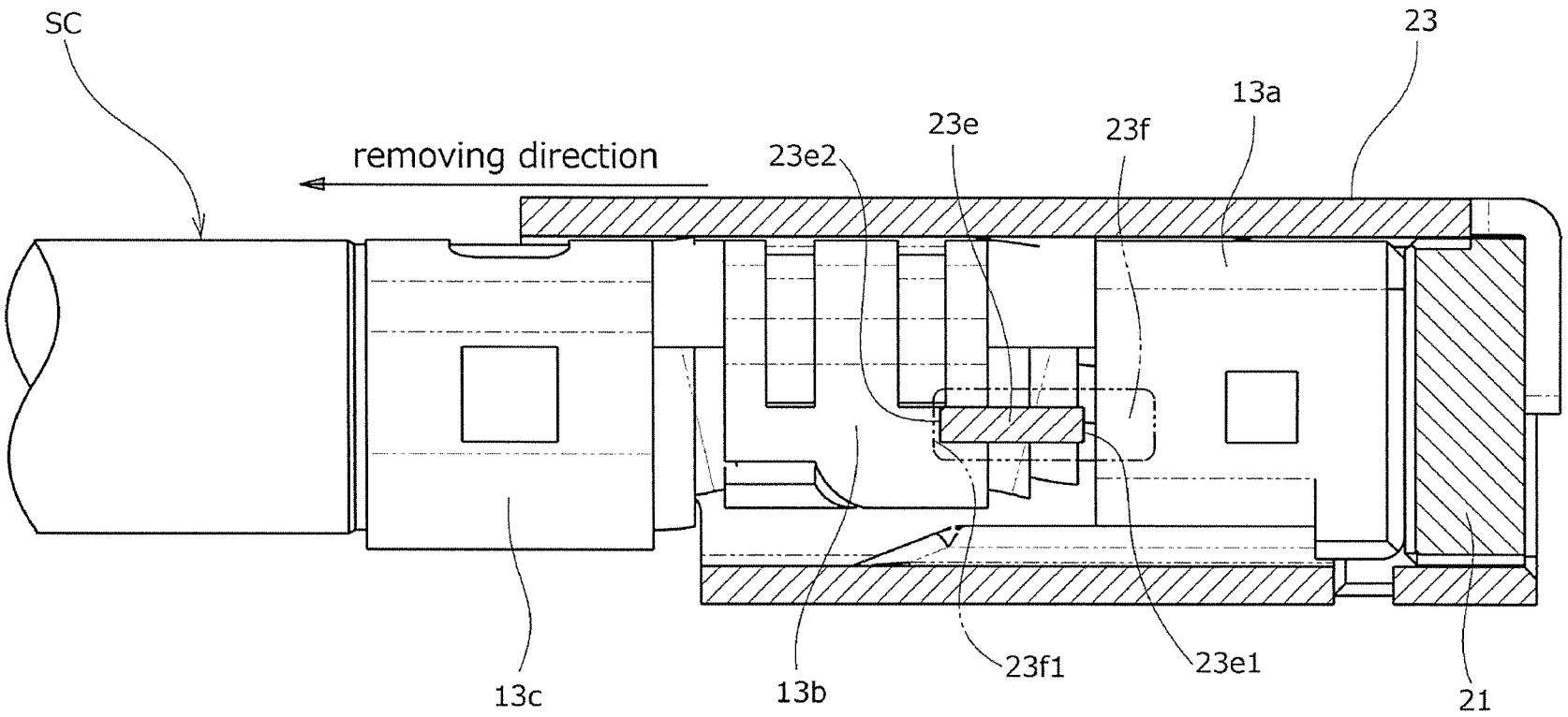
FIG. 26 is a horizontal sectional view along a XXVI-XXVI line in FIG. 22.

That is, particularly as depicted in FIG. 18 and FIG. 19, the above-described receptacle contact member 22 is formed of a thin metal plate folded so as to form a substantially U shape in a planar view. A contact base part 22*b* configuring a closed portion of that U shape is brought into a fixed state inside the insulation housing 21. This contact base part 12*b* is configured of a plate-shaped member protruding from the bottom position of the above-described insulation housing 21 toward the "above". From both end edges of the contact base part 12*b* in an upper region in the "width direction", the paired electrode parts (contact parts) 22*a* protrude toward the "front", which is at the front in the fit-in direction. These electrode parts (contact parts) 22*a* protrude from the above-described contact attachment grooves 21*a* of the insulation housing 21 toward the "front", that is, at the front in the fit-in direction. At tip portions of these paired electrode parts 22*a* in a protruding direction, contact parts 22*c* swelling in a direction of approaching each other (width direction) are provided so as to form a mount shape in a planar view. A space between these contact parts 22*c* is set slightly smaller than the space between the electrode parts 12*a* of the plug contact member 12. When the plug connector (first connector) 10 fits as being inserted in the receptacle connector (second connector) 20, an arrangement relation is such that the electrode parts 12*a* of the plug contact member 12 are inserted between the contact parts 22*c* provided to the electrode parts 22*a* of the receptacle contact member 22 to be brought into an electrical contact state.

Also, in the receptacle contact member 22, as depicted in FIG. 19, a "lower" portion of the above-described electrode parts 22*a* in the "height direction" is provided with paired fixing pieces 22*d* protruding from both side end edges of the contact base part 22*b* in the "width direction" to the outside similarly in the "width direction". These paired fixing pieces 22*d* are brought into an engaged state with respect to the side wall parts of the insulation housing 21 when the receptacle contact member 22 is attached to the insulation housing 21, thereby maintaining the entire receptacle contact member 22 in a state of being fixed to the insulation housing 21.

Furthermore, in a "lower" portion of the above-described fixing pieces 22*d* in the "height" direction, a lower end portion of the contact base part 22*b* is curved at a substantially right angle toward the "back" to protrude substantially in the "horizontal direction" to form a board connection part 22*e*. The board connection part 22*e* is soldered onto the main surface of the wiring board omitted in the drawings, thereby mounting the receptacle connector (second connector) 20.

[Conductive Shell Member]

Figure 13:
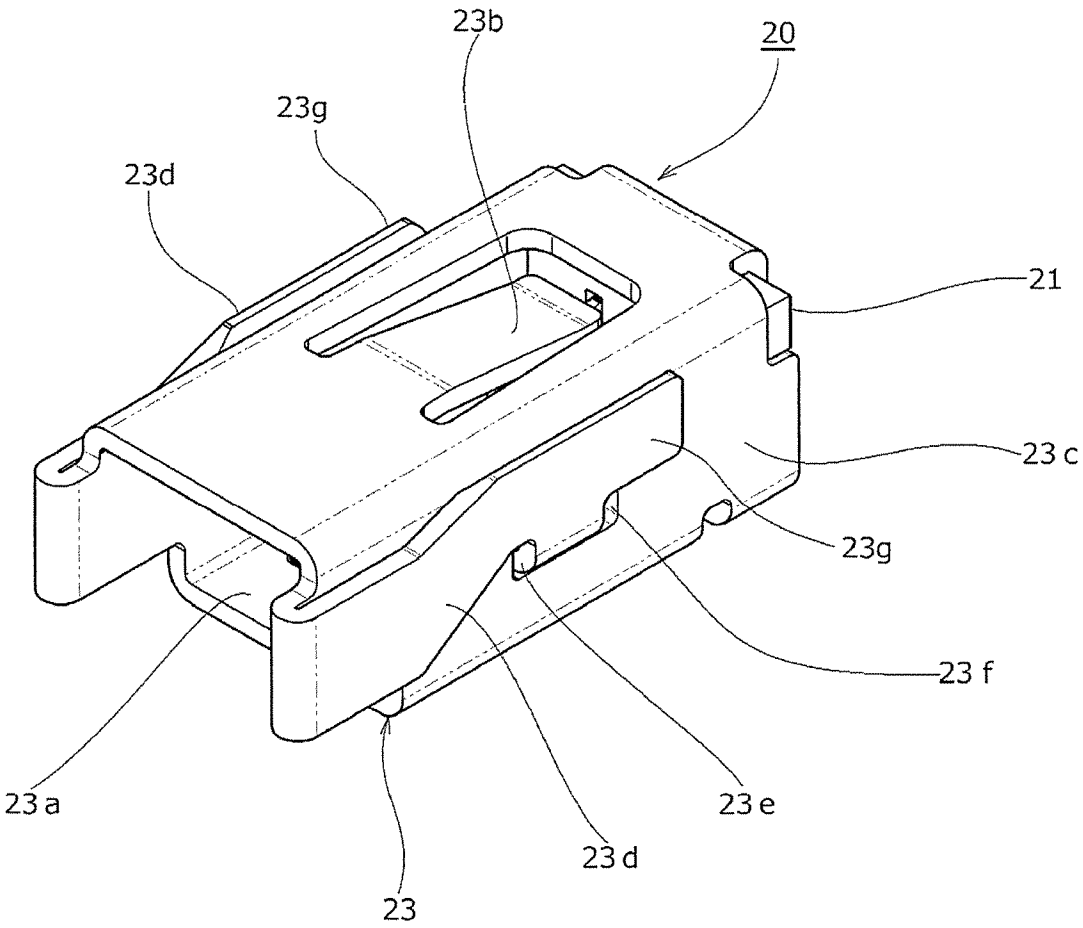
FIG. 13 is an external perspective view of a receptacle connector as a coaxial electrical connector according to one embodiment of the present invention when viewed from front and above.

On the other hand, the above-described conductive shell member 23 formed of a thin, plate-shaped metal member which covers the outer peripheral surface of the insulation housing 21 is configured of a hollow structure forming a substantially square pole shape as depicted in FIG. 13. The insulation housing 21 is attached to an end portion (depth end portion in the fit-in direction) at the "back" inside the hollow of the conductive shell member 23. The shell opening 23*a* provided at the "front" end portion (front portion in the fit-in direction) inside the hollow of the conductive shell member 23 has a substantially rectangular opening shape in a front view. A portion from the shell opening 23*a* to the above-described insulation housing 21 is taken as a "hollow insertion passage" where the above-described plug connector (first connector) 10 is inserted.

This conductive shell member 23 has a bottom surface part facing the main surface of the wiring board (omitted in the drawings) at the time of mounting. At an upper surface part opposing the bottom surface part of the conductive shell member 23 in the "height direction", a ground contact piece 23*b* formed in a tongue shape is provided as being cut and raised in a cantilever shape toward the inside of the hollow of the conductive shell member 23. An arrangement relation is such that this ground contact piece 23*b* provided to the receptacle connector (second connector) 20 elastically makes contact with an upper surface part of the conductive shell member 12 of the plug connector (first connector) 10 fitting in the receptacle connector 20 for ground connection.

Also, of edge parts of the opening in a substantially rectangular shape in a front view forming the shell opening 23*a* of the conductive shell member 23, front end edge parts of side wall surface parts 23*c* forming both end edges in the "width direction" are provided integrally with elastic arm-shaped members 23*d* each formed of a band-plate-shaped member. These elastic arm-shaped members 23*d* each once protrude from the edge part of the opening of the shell opening 23*a* toward the "front" (at the front in the fit-in direction) and, immediately after that, is folded toward the "back" (depth in the fit-in direction) opposite to the front to form a substantially U shape in a planar view. Then, from that folded part, the elastic arm-shaped member 23*d* protrudes in a cantilever shape along the outer surface of the side wall surface part 23*c* toward the "back" (depth in the fit-in direction).

Each of these elastic arm-shaped members 23*d* is configured so as to extend substantially horizontally, with a portion near the folded part taken as a root portion, and is thus elastically displaced in the "width direction" in a horizontal plane orthogonal to the fit-in direction.

As described above, the elastic arm-shaped member 23*d* in the present embodiment extends from the shell opening 23*a* of the conductive shell member 23 and then protrudes as being folded in a direction opposite to the protruding direction. Thus, an elastic span is prolonged by the folded portion, thereby sufficiently ensuring elastic displacement of the engaging piece 23*e* provided to the elastic arm-shaped member 23*d*.

These elastic arm-shaped members 23*d* can be configured so as to protrude from the conductive shell member 23 in the fit-in direction and further extend as being folded in a direction opposite to the protruding direction.

In a midway portion of each of these elastic arm-shaped members 23*d* in the protruding direction, the engaging piece 23*e* protruding toward the above-described "hollow insertion passage" of the conductive shell member 23 is provided. These engaging pieces 23*e* are each provided at a position corresponding to a substantially center portion of the conductive shell member 23 in the "front-and-back direction", being curved at a substantially right angle from the "lower" end edge part of the above-described elastic arm-shaped member 23*d* and protruding toward the inside of the connector, that is, in a direction toward the "hollow insertion passage" of the conductive shell member 23. With elastic displacement of each elastic arm-shaped member 23*d* as described above, each engaging piece 23*e* is elastically displaced in the "width direction", that is, the direction orthogonal to the fit-in direction (refer to FIG. 24).

On the other hand, at a position of each side wall surface part 23*c* of the conductive shell member 23 described above corresponding to the engaging piece 23*e*, a through hole 23*f* in a substantially rectangular shape in a side view is formed. This through hole 23*f* is provided so as to penetrate through the above-described side wall surface part 23*c* in a plate thickness direction. The engaging piece 23*e* is inserted into (penetrates through) the through hole 23*f* from outside in the "width direction".

An arrangement relation is such that the engaging piece 23*e* inserted into this through hole 23*f* protrudes to be buried in the hollow insertion passage of the conductive shell member 23 in the "width direction", with elastic displacement of the above-described elastic arm-shaped member 23*d*. That is, in an "initial state" before the plug connector (first connector) 10 is inserted into the "hollow insertion passage", the engaging piece 23*e* is being in a state of protruding inside the "hollow insertion passage" as depicted in FIG. 28A. From the "initial state", the elastic arm-shaped member 23*d* (engaging piece 23*e*) makes contact with the shell main body part 13*a* to be elastically displaced so as to be spread toward the outside in the "width direction" as depicted in FIG. 28B, thereby causing the engaging piece 23*e* to be removed from the inside of the above-described "hollow insertion passage" to proceed to a buried state.

An outer edge part of the engaging piece 23*e* provided so as to protrude to be buried in the "hollow insertion passage" of the conductive shell member 23 through the through hole 23*f* of the conductive shell member 23 has a substantially trapezoidal shape in a planar view as depicted in FIG. 24 and FIG. 28A to FIG. 28D. A depth end edge (rear end edge) of this outer edge part of the engaging piece 23*e* in the fit-in direction is formed as a connector contact surface 23*e*1 which is relatively long in the "width direction". An edge at the front (front end face) in the fit-in direction provided so as to be opposed to the connector contact surface 23*e*1 is formed as a shell contact surface 23*e*2 which is relatively short in the "width direction". These connector contact surface 23*e*1 and the shell contact surface 23*e*2 have an arrangement relation of extending substantially parallel to each other at a predetermined space in the fit-in direction (front-and-back direction).

As described above, the connector contact surface 23*e*1 of the engaging piece 23*e* is arranged in a state of forming a relatively large protrusion length inside the "hollow insertion passage" of the conductive shell member 23. When the plug connector (first connector) 10 is inserted in that "hollow insertion passage", as depicted in FIG. 28C, an arrangement relation is such that a rear-end contact surface 13*d* forming a "back" end face (end face at the front in the fit-in direction) of the shell main body part 13*a* configuring the conductive shell member 13 of the plug connector 10 faces the above-described connector contact surface 23*e*1 of the engaging piece 23*e* from the depth in the fit-in direction. In this state, when an external force in a removing direction is applied to the plug connector 10, the shell main body part 13*a*, which is part of the conductive shell member 13 of the plug connector 10, makes contact with the connector contact surface 23*e*1 of the engaging piece 23*e* from the depth to the front in the fit-in direction, thereby retaining the plug connector 10 in the "hollow insertion passage".

On the other hand, as described above, from a state in which the rear-end contact surface 13*d* of the shell main body part 13*a* configuring the conductive shell member 13 of the plug connector (first connector) 10 faces the connector contact surface 23*e*1 of the engaging piece 23*e* from the depth in the fit-in direction, when the elastic arm-shaped member 23*d* becomes elastically displaced toward the outside in the "width direction" and the engaging piece 23*e* is brought into a state of being removed from the "hollow insertion passage" toward the outside in the "width direction", the entire engaging piece 23*e* including the connector contact surface 23e1 as a whole is pulled out to an outer position not in contact with the conductive shell member 13 of the plug connector 10 inserted in the "hollow insertion passage", allowing removal of the plug connector 10.

Also, the above-described shell contact surface 23e2 configuring an end edge at the front (front end edge) of the engaging piece 23e in the fit-in direction is arranged in a state of forming a relatively small protrusion length toward the "hollow insertion passage". As depicted in FIG. 24 and FIG. 28A to FIG. 28D, of opening edge parts forming the above-described through hole 23f, an engaging contact edge 23f1, which is an end edge positioned at the front (front end edge) in the fit-in direction, is arranged in a state of being close to or making contact with this shell contact surface 23e2 provided to the engaging piece 23e, from the front in the fit-in direction.

An arrangement relation is such that when a rear end contact surface 13d of the shell main body part 13a, which is part of the conductive shell member 13 of the plug connector (first connector) 10 inserted in the "hollow insertion passage" as described above, makes contact with the connector contact surface 23e1 of the engaging piece 23e from the depth in the fit-in direction to the removing direction to press and move the entire engaging piece 23e toward the front (removing direction) in the fit-in direction, as depicted in FIG. 28D, the above-described shell contact surface 23e2 of the engaging piece 23e makes contact with an engaging contact edge 23f1 positioned at the front of the through hole 23f in the fit-in direction.

In this manner, the engaging piece 23e in contact with the engaging contact edge 23f1 of the through hole 23f is brought into a state of being interposed between part of the conductive shell member 13 of the plug connector (first connector) 10 described above (the rear end contact surface 13d of the shell main body part 13a) and the above-described engaging contact edge 23f1 of the through hole 23f, thereby avoiding a situation in which the engaging piece 23e is removed from the plug connector 10.

Furthermore, from a tip of the above-described outer edge part of the engaging piece 23e from which the shell contact surface 23e2 protrudes into the hollow insertion passage, as depicted in FIG. 24 and FIG. 28A to FIG. 28D, a guide tilted side 23e3 protrudes so that the amount of swelling toward the fit-in direction into the hollow insertion passage is increased. A positional relation is such that the above-described conductive shell member 13 of the plug connector (first connector) 10 inserted into the "hollow insertion passage" is arranged so as to make contact with this guide tilted side 23e3 from the front in the fit-in direction.

That is, as described above, when the plug connector (first connector) 10 is inserted in the "hollow insertion passage" of the receptacle connector (second connector) 20, firstly, as depicted in FIG. 28A, a front end portion (depth end portion in the fit-in direction) of the shell main body part 13a configuring the conductive shell member 13 of the plug connector 10 makes contact with the above-described guide tilted side 23e3 of the engaging piece 23e. Then, as the insertion of the plug connector 10 proceeds, the engaging piece 23e is displaced against the elastic force of the elastic arm-shaped member 23d to be pushed to the outside in the "width direction", as depicted in FIG. 28B.

Then, as depicted in FIG. 28C, at the end of fitting the plug connector 10, the conductive shell member 13 of the plug connector 10 is removed from the engaging piece 23e to the fit-in direction, thereby causing the engaging piece 23e to be returned to the original position by following the elasticity of the elastic arm-shaped member 23d. As a result, the rear-end contact surface 13d configuring the conductive shell member 13 of the plug connector 10 is arranged in a state of opposing the connector contact surface 23e1 of the engaging piece 23e from the depth in the fit-in direction.

Then, from the opposing state between the conductive shell member 13 of the plug connector 10 and the engaging piece 23e as described above, when the plug connector 10 receives an external force to a direction of removal from the receptacle connector 20, the rear-end contact surface 13d of the shell main body part 13a configuring the conductive shell member 13 of the plug connector 10 makes contact with the engaging piece 23e from the depth in the fit-in direction. This regulates the movement of the plug connector 10, basically preventing the removal of the plug connector 10.

When the external force in the direction of removal from the receptacle connector (second connector) 20 is further continuously applied to the plug connector (first connector) 10 as described above, as depicted in FIG. 28D, the engaging piece 23e moves in the inner region of the through hole 23f toward the "back", which is the front in the fit-in direction, with elastic displacement of the elastic arm-shaped member 23d, and the shell contact surface 23e2 of the engaging piece 23e makes contact with the engaging contact edge 23f1 of the through hole 23f opposingly arranged at the front in the fit-in direction, which is part of the conductive shell member 23. From this point onward, the removal of the plug connector 10 is firmly prevented.

An protrusion end portion of each elastic arm-shaped member 23, that is, a portion protruding in a cantilever shape from the above-described engaging piece 23e in the fit-in direction, is formed as a release operation part 23g for removing the engaging piece 23e from the hollow insertion passage, as depicted in FIG. 13. When a release operation force toward the outside in the "width direction" is applied to each of these release operation parts 23g, the engaging piece 23e and the elastic arm-shaped member 23 are elastically displaced to the outside in the "width direction", and is displaced to a position where the engaging piece 23e does not make contact with the plug connector (first connector) 10, thereby allowing the plug connector 10 to be removed.

As described above, according to the structure of the present embodiment, when an external force is applied in the removing direction, which is a direction opposite to the fit-in direction, to the plug connector (first connector) 10, which is a mating connector brought into a state of fitting in the receptacle connector (second connector) 20, the conductive shell member 13, which is part of the plug connector 10, makes contact with the connector contact surface 23e1 of the engaging piece 23e of the receptacle connector 20 from the depth in the fit-in direction. Also, the shell contact surface 23e2 of the engaging piece 23e makes contact with the engaging contact edge 23f1 of the through hole 23f, which is part of the conductive shell member 23 of the receptacle connector 20 and is opposingly arranged at the front in the fit-in direction with respect to the shell contact surface 23e2. As a result, the engaging piece 23e is brought into a state of being interposed between the plug connector 10 and the conductive shell member, thereby avoiding a situation in which the engaging piece 23e is removed from the plug connector 10 to cause a lock release.

While the invention made by the inventor has been specifically described based on the embodiment, the embodiment is not limited to the one described above and, needless to say, can be variously modified in a range not deviating from the gist of the present invention.

While the present invention is applied an electrical connector of a horizontally fitting type in the above-described embodiment, the present invention can be similarly applied to, for example, an electrical connector of a vertically fitting type.

Furthermore, the present invention is not limited to a single-core fine-line coaxial cable connector as described in the above-described embodiment, and can also be similarly applied to an axial cable connector arranged in a multipolar manner, an electrical connector of a type with a plurality of coaxial cables and insulating cables being mixed, and so forth.

As has been described above, the present embodiment can be widely applied to electrical connectors of various types for use in electrical appliances.

What is claimed is:

1. An electrical connector which a mating connector having a terminal portion of a signal transmission medium coupled thereto fits in, the electrical connector comprising:

a contact member extending in a fit-in direction of the mating connector and arranged so as to be able to make contact with an electrode part of the mating connector; and a conductive shell member formed of a plate-shaped metal member having a wall surface part in a plate thickness direction and being arranged in a state of surrounding at least part of the contact member, wherein the conductive shell member is provided with an elastic arm-shaped member which makes contact with the mating connector when fitting in the mating connector and elastically displaces in a direction orthogonal to the fit-in direction, the elastic arm-shaped member is provided with an engaging piece which makes contact with the mating connector, wherein, after protruding from the conductive shell member to the fit-in direction or a direction opposite thereto, the elastic arm-shaped member extends in a state of being folded to a direction opposite to a protruding direction, the engaging piece has a connector contact surface and a shell contact surface, the connector contact surface comes to make contact with a contact face of the mating connector at a depth of the engaging piece in the fit-in direction when an external force is applied to the mating connector in a fit-in state in a removing direction opposite to the fit-in direction, and the shell contact surface is provided to oppose the connector contact surface and comes to make contact with a part of the conductive shell member when the contact face of the mating connector makes contact with the connector contact surface to restrict movement of the mating connector, and the wall surface part in the plate thickness direction forming the connector contact surface and the shell contact surface to extend approximately orthogonally to the direction in which the elastic arm-shaped member is extending after being folded.

2. The electrical connector according to claim wherein the conductive shell member which the shell contact surface of the engaging piece faces is partially configured of an opening edge part of a through hole provided in the conductive shell member to have the engaging piece inserted therein.

3. The electrical connector according to claim 1, wherein the conductive shell member is provided with a release operating part which displaces the conductive shell member to a position where the engaging piece does not make contact with the mating connector.

4. The electrical connector according to claim 1, wherein the mating connector which the connector contact surface of the engaging piece faces is partially the conductive shell member provided to the mating connector.

5. An electrical connector device comprising:

a first connector having a terminal portion of a cable-shaped signal transmission medium coupled thereto and a second connector which the first connector fits in, the second connector being provided with a contact member extending in a fit-in direction of the first connector and arranged so as to be able to make contact with an electrode part of the first connector and a conductive shell member formed of a plate-shaped metal member having a wall surface part in a plate thickness direction and being arranged in a state of surrounding at least part of the contact member, wherein the conductive shell member of the second connector is provided with an elastic arm-shaped member which makes contact with the first connector when the first connector and the second connector fit in and elastically displaces in a direction orthogonal to the fit-in direction, the elastic arm-shaped member of the second connector is provided with an engaging piece which makes contact with the first connector, wherein, after protruding from the conductive shell member in the fit-in direction or a direction opposite thereto, the elastic arm-shaped member extends in a state of being folded to a direction opposite to a protruding; direction, the engaging piece of the second connector has a connector contact surface which comes to make contact with a contact face of the first connector at a depth of the engaging piece in the fit-in direction when an external force is applied to the first connector in a fit-in state in a removing direction opposite to the fit-in direction, and a shell contact surface which is provided to oppose the connector contact surface and comes to make contact with a part of the conductive shell member when the contact face of the first connector makes contact with the connector contact surface to restrict movement of the first connector, and the wall surface part in the plate thickness direction forming the connector contact surface and the shell contact surface to extend approximately orthogonally to the direction in which the elastic arm-shaped member is extending after being folded.

6. The electrical connector device according to claim 5, wherein the elastic arm-shaped member and the engaging piece are provided as a set in a state of opposing to a direction orthogonal to the fit-in direction.

7. The electrical connector device according to claim 5, wherein the conductive shell member which the shell contact surface of the engaging piece faces is partially configured of an opening edge part of a through hole provided in the conductive shell member to have the engaging piece inserted therein.

8. The electrical connector device according to claim 5, wherein the conductive shell member is provided with a release operating part which displaces the conductive shell member to a position where the engaging piece does not make contact with the mating connector or the first connector.

9. The electrical connector device according to claim 5, wherein the first connector which the connector contact surface of the engaging piece faces is partially the conductive shell member provided to the first connector.

* * * * *